US011719418B2

(12) United States Patent
Togawa et al.

(10) Patent No.: US 11,719,418 B2
(45) Date of Patent: Aug. 8, 2023

(54) BACK PANEL FOR LIGHTING DEVICE AND LIGHTING DEVICE

(71) Applicant: CCS Inc., Kyoto (JP)

(72) Inventors: Takuzo Togawa, Kyoto (JP); Takahiko Koyama, Otsu (JP)

(73) Assignee: CCS INC., Kyoto (JP)

( * ) Notice: Subject to any disclaimer, the term of this patent is extended or adjusted under 35 U.S.C. 154(b) by 72 days.

(21) Appl. No.: 17/450,807

(22) Filed: Oct. 13, 2021

(65) Prior Publication Data

US 2022/0120415 A1 Apr. 21, 2022

(30) Foreign Application Priority Data

Oct. 16, 2020 (JP) ..... 2020-174609
Sep. 17, 2021 (JP) ..... 2021-152091

(51) Int. Cl.
*F21V 19/00* (2006.01)

(52) U.S. Cl.
CPC ..... *F21V 19/003* (2013.01)

(58) Field of Classification Search
CPC ..... F21Y 2115/15
See application file for complete search history.

(56) References Cited

U.S. PATENT DOCUMENTS

| | | | | |
|---|---|---|---|---|
| 9,851,076 | B2 * | 12/2017 | Onishi | B60Q 3/43 |
| 10,697,627 | B1 * | 6/2020 | Fukushima | F21V 23/002 |
| 2014/0247584 | A1 * | 9/2014 | Kodama | H02S 30/10 362/183 |
| 2017/0111993 | A1 * | 4/2017 | Lang | H05K 1/147 |
| 2017/0284627 | A1 | 10/2017 | Lee et al. | |
| 2018/0259141 | A1 * | 9/2018 | Yamaguchi | F21V 33/00 |
| 2020/0348009 | A1 * | 11/2020 | Ansems | H10K 50/805 |

FOREIGN PATENT DOCUMENTS

JP 2017527082 A 9/2017

* cited by examiner

*Primary Examiner* — Eric T Eide
(74) *Attorney, Agent, or Firm* — Alleman Hall Creasman & Tuttle LLP

(57) ABSTRACT

A back panel for a lighting device includes a front panel holding portion, the front panel holding portion has a configuration capable of setting a size of a gap between a front panel held by the front panel holding portion and a panel main body to an arbitrary size.

10 Claims, 16 Drawing Sheets

BACK PANEL FOR LIGHTING DEVICE AND LIGHTING DEVICE

TECHNICAL FIELD

The present invention relates to a back panel for a lighting device and a lighting device including the same.

BACKGROUND ART

Conventionally, as described in JP 2017-527082 T, a bendable lighting using an organic light emitting diode (OLED) is known.

The publication describes a lighting including an OLED lighting sheet, a transparent film that protects the OLED lighting sheet, and a rectangular casing plate (back panel) that houses and supports the OLED lighting sheet and the transparent film. The back panel includes a back cover portion that is in surface-contact with a back surface of the OLED lighting sheet, side protruding end portions that protrude perpendicularly from both side surfaces of the back cover portion, and a guide arm portion that extends inward from the side protruding end portions. The OLED lighting sheet and the transparent film are supported by the back panel as a result of insertion of both end portions of the sheet and the film in width directions thereof into a gap (groove) between the guide arm portion and the back cover portion.

In the back panel described in the above publication, grooves are formed at both end portions in a width direction of the back panel over the entire length direction of the back panel. Both end portions of the OLED lighting sheet (light-emitting panel) are inserted into the grooves. Here, the light-emitting panel has a laminated structure including various constituent elements (e.g., a diffusion plate, a polarizing plate, an LC film, a color filter, or the like) in addition to a light-emitting layer and an electrode. The light-emitting panel has various thicknesses depending on its specifications. Since in the back panel described in the above publication, the groove has a constant size, it is difficult to flexibly cope with a change in the thickness of the light-emitting panel.

SUMMARY OF INVENTION

An object of the present invention is to provide a back panel for a lighting device that can flexibly cope with a change in thickness of a light-emitting panel, and a lighting device including the back panel.

According to one aspect of the present invention, a back panel for a lighting device is adapted for sandwiching and holding a light-emitting panel for lighting with a front panel. The back panel for a lighting device includes: a panel main body disposed along a back surface on a side opposite to a light-emitting surface of the light-emitting panel at a time of holding the light-emitting panel, the time when the light-emitting panel is held by the back panel for a lighting device; and a front panel holding portion that holds the front panel at a position where the front panel sandwiches the light-emitting panel with the panel main body at the time of holding the light-emitting panel. The front panel holding portion has a configuration capable of setting a size of a gap between the front panel held by the front panel holding portion and the panel main body to an arbitrary size.

According to another aspect of the present invention, a lighting device includes: the above-mentioned back panel for a lighting device which has at least a part of the panel main body being curved; the light-emitting panel curved along one main surface of the panel main body; and the front panel that is held by the front panel holding portion to sandwich the light-emitting panel with the panel main body, the front panel being curved along the light-emitting panel.

DESCRIPTION OF EMBODIMENTS

Hereinafter, a back panel for a lighting device and a lighting device according to an embodiment of the present invention will be described in detail with reference to the drawings.

First Embodiment

First, a configuration of a back panel 110 for a lighting device (hereinafter, also simply referred to as a "back panel 110") according to a first embodiment of the present invention will be described with reference to FIG. 1 to FIG. 7.

Figure 1:
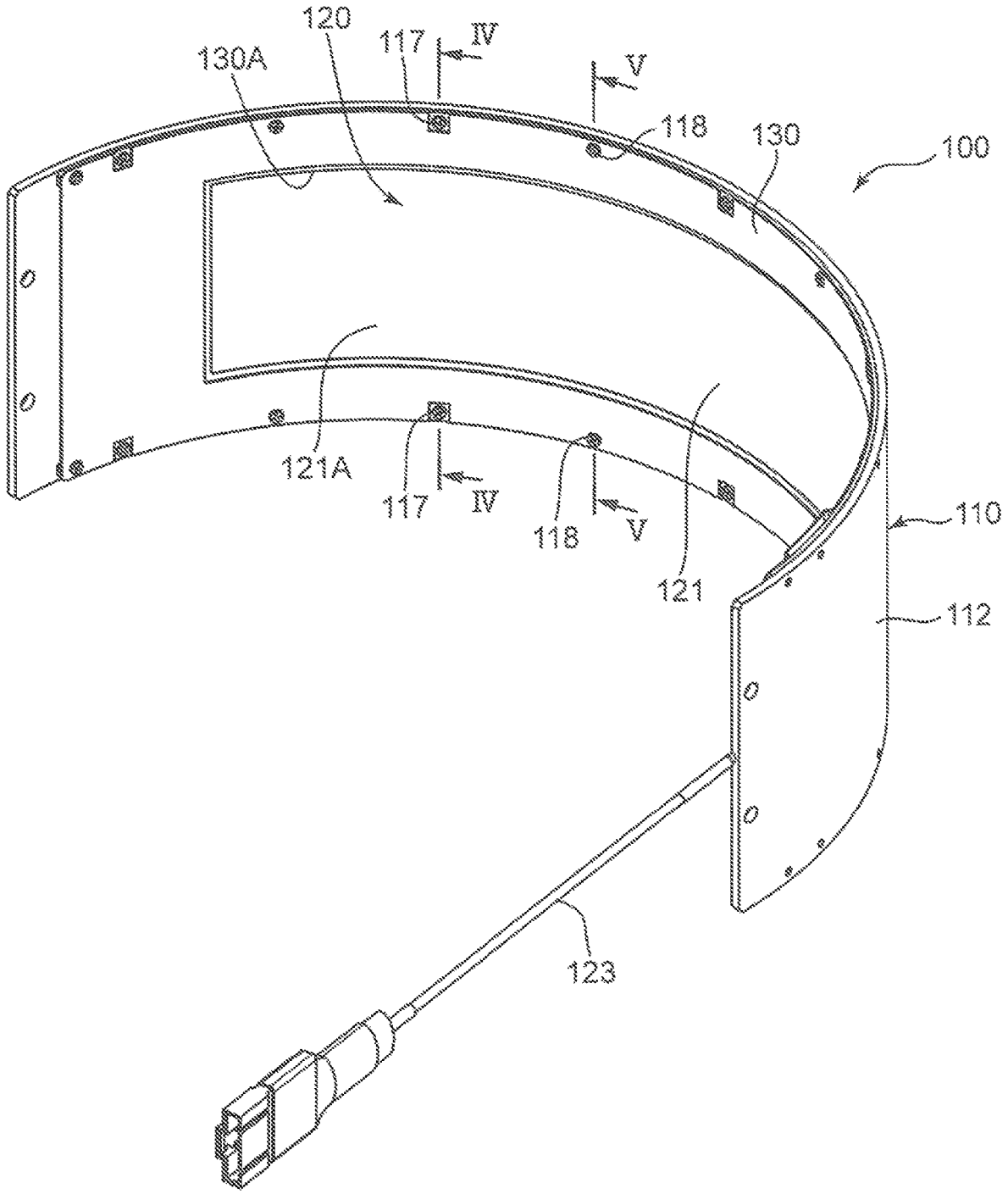
FIG. 1 is a perspective view schematically illustrating a configuration of a lighting device according to a first embodiment of the present invention.
Figure 2:
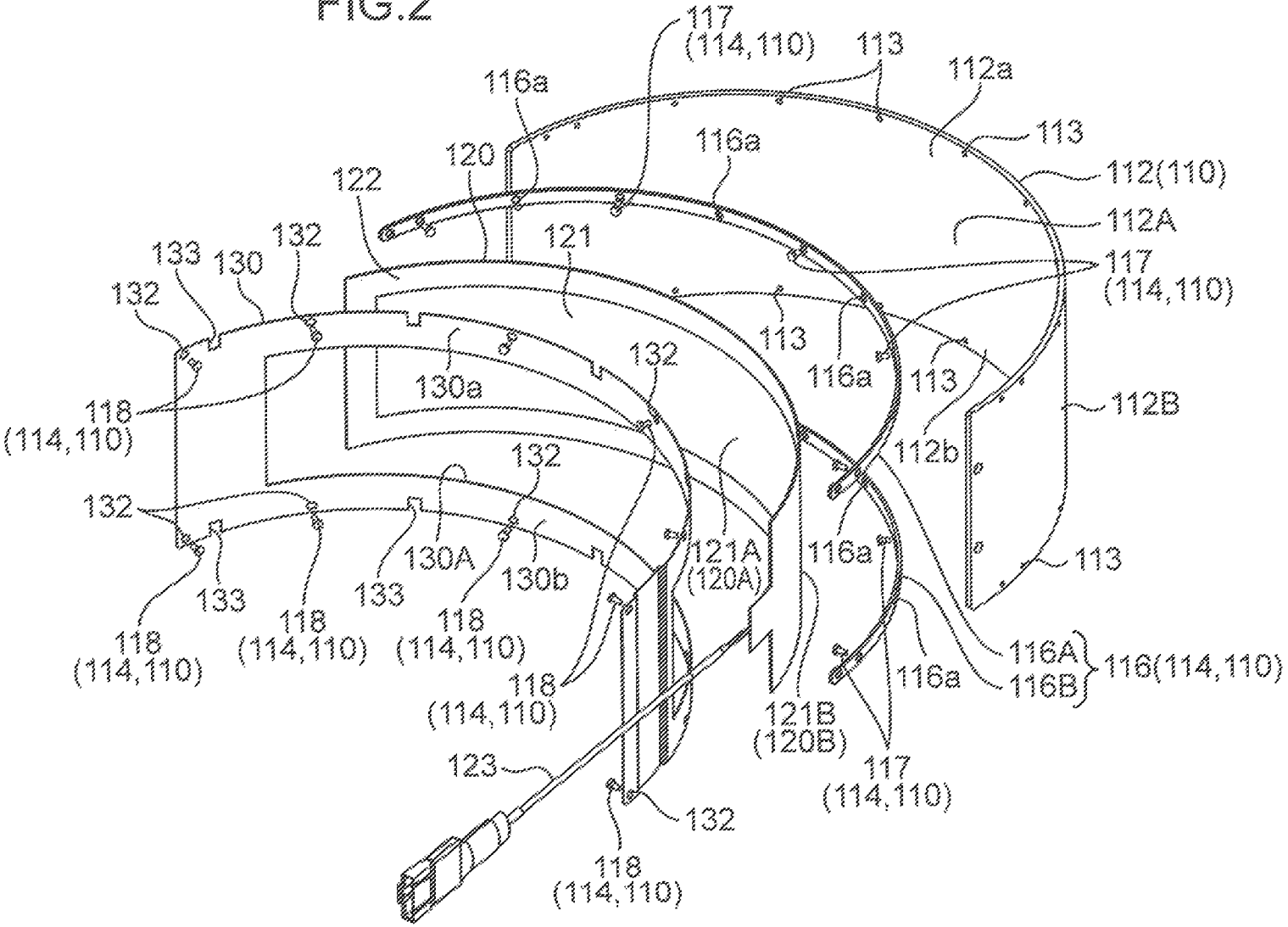
FIG. 2 is an exploded perspective view of the lighting device according to the first embodiment.
Figure 3:
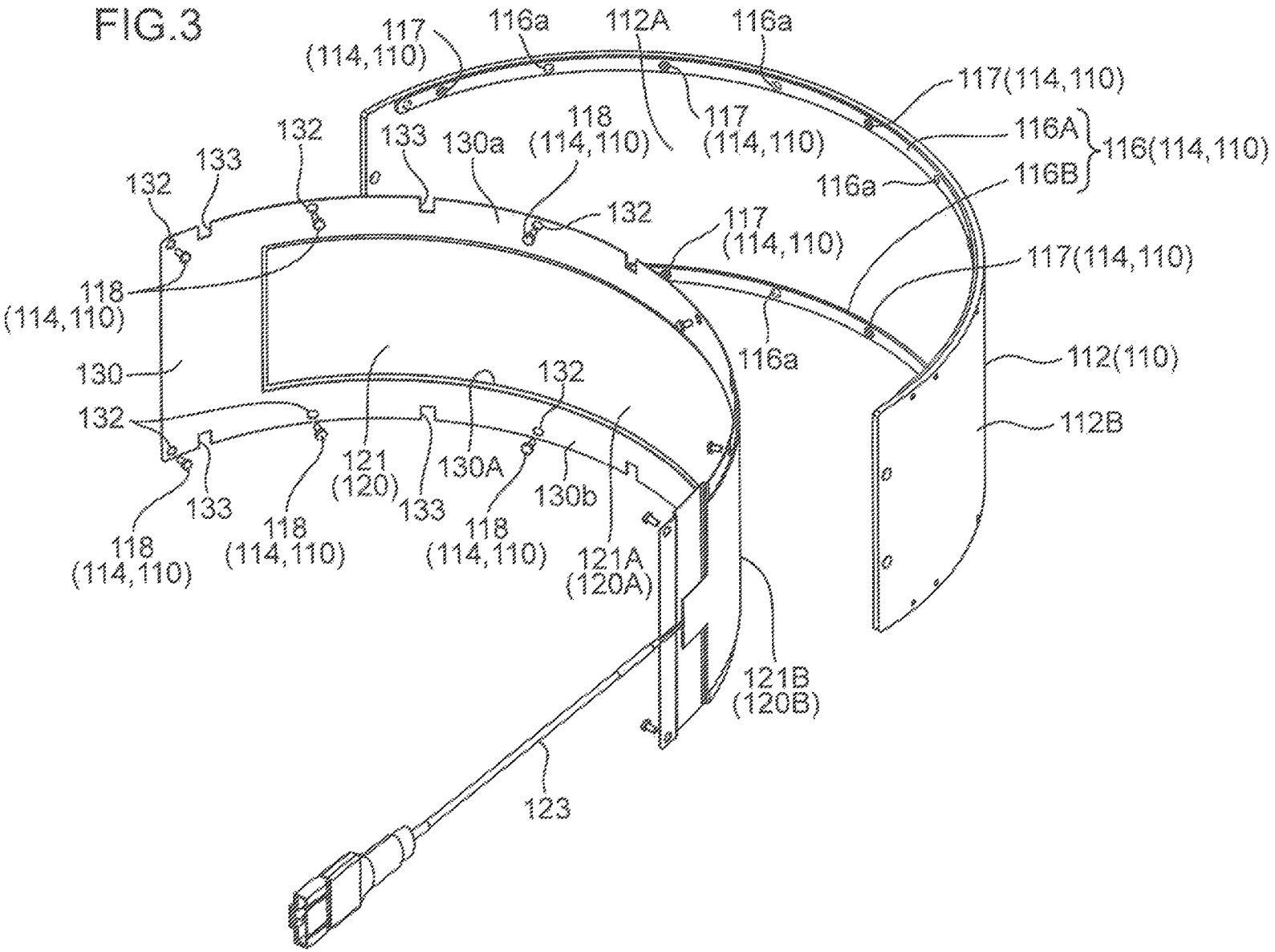
FIG. 3 is a view illustrating a state in which integrated front panel and light-emitting panel are separated from a back panel for a lighting device in the lighting device according to the first embodiment.

The back panel 110 is adapted for sandwiching and holding a light-emitting panel 120 for lighting with a front panel 130 in a lighting device 100 (see FIG. 1) according to the first embodiment. In a state where the light-emitting panel 120 is not held by the back panel 110 and the front panel 130, the light-emitting panel 120 is a thin flat panel having a rectangular outer shape when viewed from a direction along a thickness direction of the light-emitting panel. The light-emitting panel 120 has flexibility. The back panel 110 according to the first embodiment sandwiches the light-emitting panel 120 with the front panel 130 from both sides in the thickness direction of the light-emitting panel and holds the light-emitting panel in a curved shape. As illustrated in FIG. 2 and FIG. 3, the back panel 110 includes a panel main body 112 and a front panel holding portion 114.

The panel main body 112 is disposed along a back surface 121B of the light-emitting panel 120 when the light-emitting panel 120 is held by the back panel 110 and the front panel 130. The back surface 121B of the light-emitting panel 120 is a surface on a side opposite to a light-emitting surface 121A. As illustrated in FIG. 2, the panel main body 112 is formed of a plate body curved with a constant curvature. Although in the first embodiment, a material of the panel main body 112 is a material having relatively high thermal conductivity such as aluminum in consideration of heat dissipation, the material of the panel main body 112 is not limited thereto.

The panel main body 112 has a first main surface 112A facing the back surface 121B of the light-emitting panel 120 at the time of holding the light-emitting panel, and a second main surface 112B facing a side opposite to the first main surface 112A. The first main surface 112A is a concave surface curved with a constant curvature. The second main surface 112B is a convex surface curved with a constant curvature.

Figure 4:
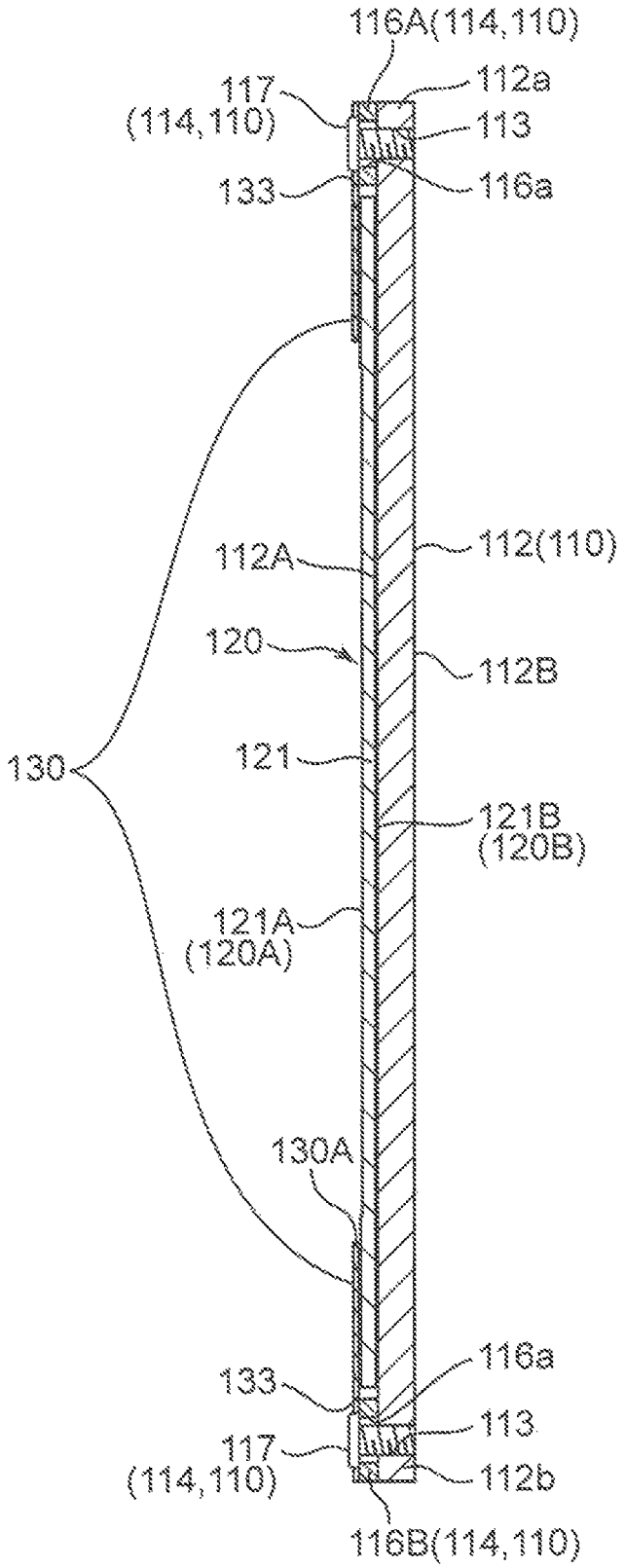
FIG. 4 is a cross-sectional view of the lighting device according to the first embodiment taken along line IV-IV in FIG. 1.
Figure 5:
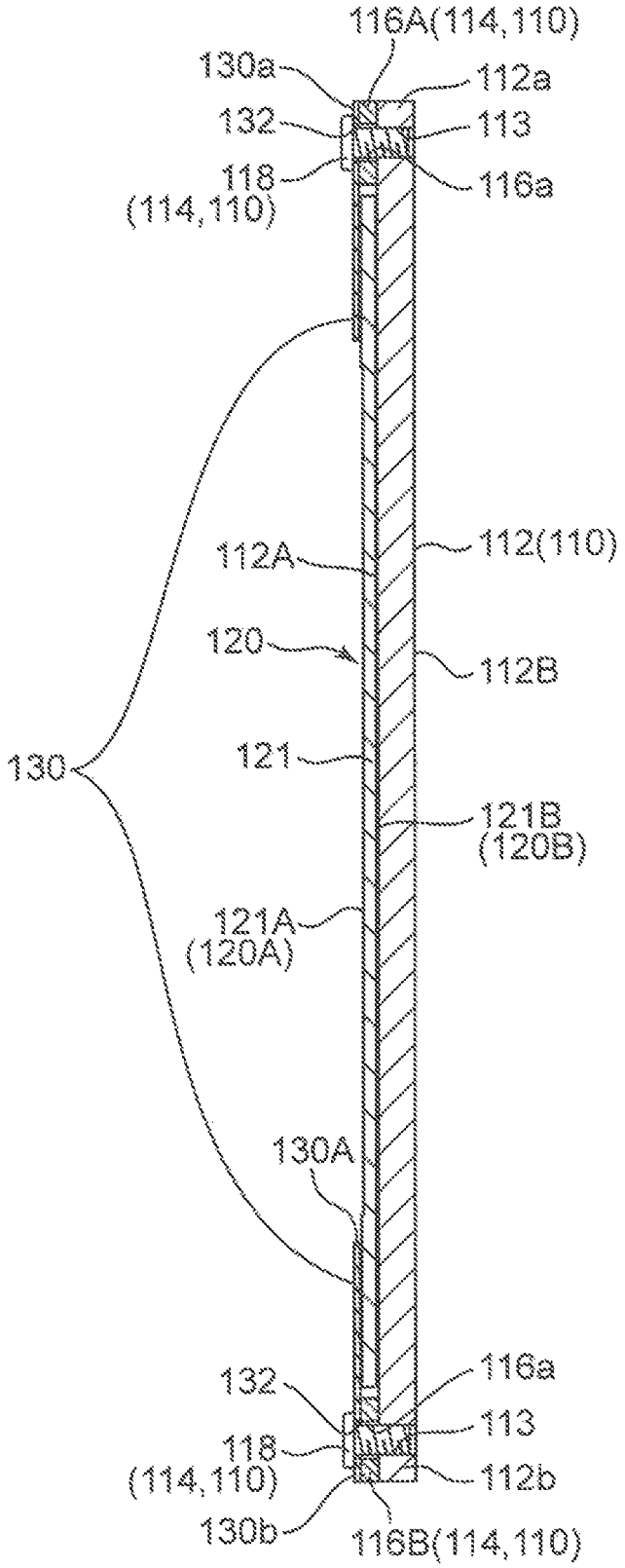
FIG. 5 is a cross-sectional view of the lighting device according to the first embodiment taken along line V-V in FIG. 1.

As illustrated in FIG. 4 and FIG. 5, the panel main body 112 includes a panel main body first outer portion 112*a* positioned on one outer side of the light-emitting panel 120 in a width direction of the light-emitting panel 120 at the time of holding the light-emitting panel, and a panel main body second outer portion 112*b* positioned on the other outer side of the light-emitting panel 120 in the width direction of the light-emitting panel 120 at the time of holding the light-emitting panel. The width direction of the light-emitting panel 120 corresponds to a direction orthogonal to both the thickness direction and an extension direction of the light-emitting panel 120. The extension direction of the light-emitting panel 120 corresponds to a length direction of the light-emitting panel 120 when the light-emitting panel 120 has a flat plate shape. Further, the extension direction corresponds to a direction along a curved shape of the light-emitting panel 120 when the light-emitting panel 120 is held by the back panel 110 and the front panel 130.

Figure 6:
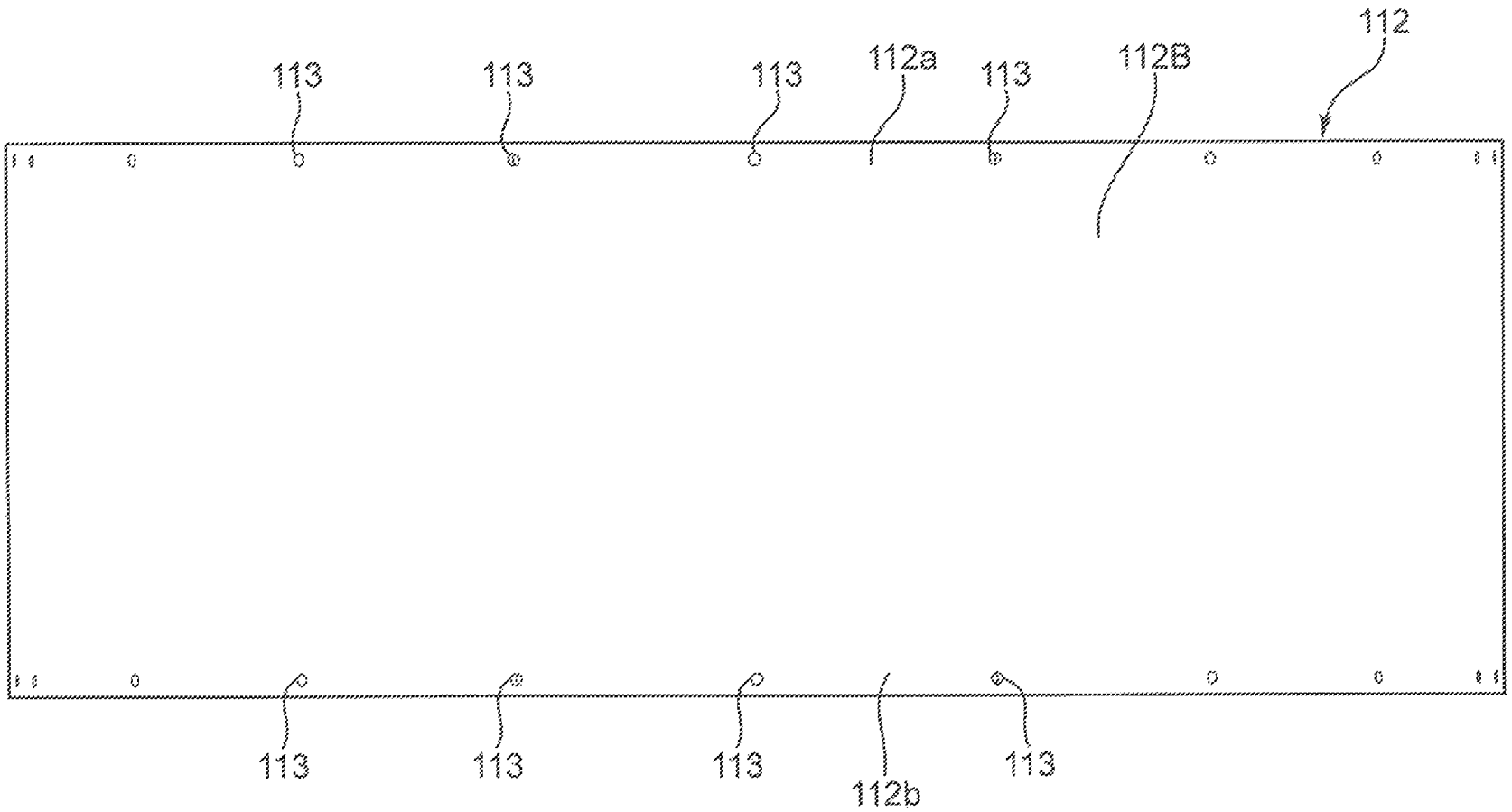
FIG. 6 is a rear view of a panel main body of the back panel for a lighting device according to the first embodiment of the present invention.
Figure 7:
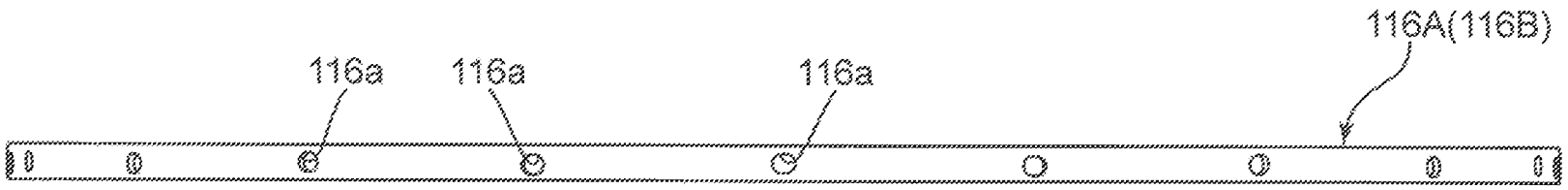
FIG. 7 is a rear view of a spacer of the back panel for a lighting device according to the first embodiment.

As illustrated in FIG. 2, each of the panel main body first outer portion 112*a* and the panel main body second outer portion 112*b* is provided with a plurality of main body screw holes 113 penetrating the outer portions 112*a* and 112*b* in the thickness direction of the first and second outer portions, respectively. As illustrated in FIG. 6, the plurality of main body screw holes 113 provided in the panel main body first outer portion 112*a* are disposed at an interval along the extension direction of the panel main body 112. Similarly, the plurality of main body screw holes 113 provided in the panel main body second outer portion 112*b* are disposed at an interval along the extension direction of the panel main body 112. The extension direction of the panel main body 112 corresponds to a direction along a curved shape of the panel main body 112.

As illustrated in FIG. 4, the front panel holding portion 114 holds the front panel 130 at a position where the front panel 130 sandwiches the light-emitting panel 120 with the panel main body 112 at the time of holding the light-emitting panel. The front panel holding portion 114 is configured such that a size of a gap between the held front panel 130 and the panel main body 112 can be changed according to the thickness of the light-emitting panel 120.

Specifically, as illustrated in FIG. 2 and FIG. 3, the front panel holding portion 114 includes a spacer 116, a plurality of spacer fastening screws 117, and a plurality of panel fastening screws 118.

The spacer 116 is placed between the front panel 130 and the panel main body 112 at the time of holding the light-emitting panel, and forms the gap, between the front panel 130 and the panel main body 112, in which the light-emitting panel 120 is housed. The spacer 116 includes a first spacer portion 116A placed between the front panel 130 and the panel main body first outer portion 112*a* at the time of holding the light-emitting panel, and a second spacer portion 116B placed between the front panel 130 and the panel main body second outer portion 112*b* at the time of holding the light-emitting panel.

The first spacer portion 116A and the second spacer portion 116B are configured in the same manner. Each of the first spacer portion 116A and the second spacer portion 116B is made of an elongated plate material. Each of the first spacer portion 116A and the second spacer portion 116B has a shape curved along the recessed first main surface 112A of the panel main body 112. Although the first spacer portion 116A and the second spacer portion 116B are made of the same material as the panel main body 112, the material of the first spacer portion 116A and the second spacer portion 116B is not necessarily limited thereto.

The first spacer portion 116A and the second spacer portion 116B are configured to be detachable between the front panel 130 and the panel main body 112. Specifically, the first spacer portion 116A is detachably attached to the panel main body first outer portion 112*a* as a result of fastening to the panel main body first outer portion 112*a*. The second spacer portion 116B is detachably attached to the panel main body second outer portion 112*b* as a result of fastening to the panel main body second outer portion 112*b*. The first spacer portion 116A extends over the entire extension direction of the light-emitting panel 120 on one outer side in the width direction of the light-emitting panel 120 in a state of being attached to the panel main body first outer portion 112*a* at the time of holding the light-emitting panel. In addition, the second spacer portion 116B extends over the entire extension direction of the light-emitting panel 120 at a position opposite to the first spacer portion 116A in the width direction of the light-emitting panel 120 in a state of being attached to the panel main body second outer portion 112*b* at the time of holding the light-emitting panel. In such a state, the first spacer portion 116A and the second spacer portion 116B form a space for housing the light-emitting panel 120 therebetween. An interval between the first spacer portion 116A and the second spacer portion 116B in the state of being attached to the panel main body first outer portion 112*a* and the panel main body second outer portion 112*b*, respectively, in this manner is set to an interval slightly larger than the width of the light-emitting panel 120.

The first spacer portion 116A and the second spacer portion 116B each have a thickness that enables the gap to be formed, between the panel main body 112 and the front panel 130, in which the light-emitting panel 120 can be housed. Specifically, both the first spacer portion 116A and the second spacer portion 116B have a thickness substantially equal to the thickness of the light-emitting panel 120. At the time of holding the light-emitting panel, the first spacer portion 116A and the second spacer portion 116B having thicknesses corresponding to the thickness of the light-emitting panel 120 are selected and attached to the panel main body first outer portion 112*a* and the panel main body second outer portion 112*b*, respectively. As a result, the size of the gap between the front panel 130, that is held by the front panel holding portion 114, and the panel main body 112 can be adjusted to a size corresponding to the thickness of the light-emitting panel 120.

Each of the first spacer portion 116A and the second spacer portion 116B is provided with a plurality of spacer screw insertion holes 116*a* penetrating in a thickness direction of the spacer portion. Each of the plurality of spacer screw insertion holes 116*a* is a hole through which the spacer fastening screw 117 or the panel fastening screw 118 is inserted. The plurality of spacer screw insertion holes 116*a* are disposed at an interval along extension directions of the first spacer portion 116A and the second spacer portion 116B along curved shapes of the first spacer portion 116A and the second spacer portion 116B (see FIG. 7).

The plurality of spacer fastening screws 117 (see FIG. 2) are screws for fastening the first spacer portion 116A and the second spacer portion 116B to the panel main body first outer portion 112*a* and the panel main body second outer portion 112*b*, respectively. As illustrated in FIG. 4, each of the plurality of spacer fastening screws 117 is inserted into the corresponding spacer screw insertion hole 116*a*, and screwed into the corresponding main body screw hole 113 of the panel main body 112 and fastened, whereby the first spacer portion 116A is fastened to the panel main body first outer portion 112*a* and the second spacer portion 116B is fastened to the panel main body second outer portion 112*b*.

The plurality of panel fastening screws 118 (see FIG. 2) are screws that fasten the front panel 130 to the panel main body 112 in a state where the spacer 116 is placed between the front panel 130 and the panel main body 112 at the time of holding the light-emitting panel. Specifically, as illustrated in FIG. 5, each of the plurality of panel fastening screws 118 is inserted into a corresponding front panel screw insertion hole 132 (described later) and the corresponding spacer screw insertion hole 116*a*, and screwed into the corresponding main body screw hole 113 of the panel main body 112 and fastened, whereby the front panel 130 is fastened to the panel main body 112 in a state where the first spacer portion 116A is placed between the panel main body first outer portion 112*a* and the front panel 130 and the second spacer portion 116B is placed between the panel main body second outer portion 112*b* and the front panel 130. By fastening the front panel 130 to the panel main body 112 by the panel fastening screw 118, the front panel 130 is held at a position where the front panel 130 sandwiches the light-emitting panel 120 with the panel main body 112. The plurality of panel fastening screws 118 fasten not only the front panel 130 but also the first spacer portion 116A and the second spacer portion 116B to the panel main body 112.

Next, a configuration of the lighting device 100 according to the first embodiment of the present invention will be described.

The lighting device 100 (see FIG. 1) is a device that emits light using an OLED as a light source. The lighting device 100 is used for appearance inspection of various cylindrical bodies and chemical ampoules. The lighting device 100 has a curved shape as a whole. The lighting device 100 includes the back panel 110, the light-emitting panel 120, and the front panel 130.

As illustrated in FIG. 2, in the back panel 110 according to the first embodiment, the panel main body 112 is curved in an arc shape such that the first main surface 112A of the panel main body 112 becomes a concave surface. A curvature radius of the panel main body 112 is not particularly limited, and can be appropriately set according to an application of the lighting device 100 and the like.

The light-emitting panel 120 is an OLED panel. The light-emitting panel 120 is a rectangular thin panel slightly smaller than the panel main body 112. The light-emitting panel 120 has flexibility. The light-emitting panel 120 is curved in an arc shape along the first main surface 112A of the panel main body 112. A cable 123 that supplies electric power to a light-emitting sheet portion 121 to be described later is connected to one end of the light-emitting panel 120 in the extension direction (the length direction). The light-emitting panel 120 has a light-emitting panel front surface 120A which is a surface including a light-emitting surface 121A to be described later, and a light-emitting panel back surface 120B which is a surface on a side opposite to the light-emitting panel front surface 120A.

The light-emitting panel 120 includes a light-emitting sheet portion 121 and a cover portion 122 covering an edge portion of the light-emitting sheet portion 121. The light-emitting sheet portion 121 has a multilayer structure in which a light emitting layer, an electrode, and the like are laminated on a thin glass plate. The light-emitting sheet portion 121 has the light-emitting surface 121A which is a surface emitting light and a back surface 121B which is a surface on a side opposite to the light-emitting surface 121A. Although an emission color of the light-emitting sheet portion 121 is, for example, white, it is not particularly limited. The light-emitting sheet portion 121 may be formed by further laminating, for example, a diffusion plate, a polarizing plate, an LC film, or a color filter.

The cover portion 122 is made of a film having a light shielding property and an electrical insulation property. For example, a black vinyl tape or the like is used for the cover portion 122. The cover portion 122 is attached to the entire edge portion of the light-emitting sheet portion 121 along the four sides of the light-emitting sheet portion 121 so as to cover an edge portion of the light-emitting surface 121A of the light-emitting sheet portion 121, an edge portion of the back surface 121B of the light-emitting sheet portion 121, and a side surface (not illustrated) of the light-emitting sheet portion 121. The side surface of the light-emitting sheet portion 121 is a surface connecting the light-emitting surface 121A and the back surface 121B. When the light-emitting sheet portion 121 is viewed from the side of the light-emitting surface 121A, the cover portion 122 is provided so as to surround the entire periphery of the light-emitting surface 121A. Since the cover portion 122 is provided in a manner as described above, light leakage from the edge portion of the light-emitting surface 121A of the light-emitting sheet portion 121, the edge portion of the back surface 121B, and the side surface can be suppressed, and electrical insulation between an electrode of the light-emitting sheet portion 121 and the front panel 130 and the back panel 110 can be more reliably secured. Further, cracking of the glass plate of the light-emitting sheet portion 121 can be also suppressed.

The front panel 130 sandwiches the light-emitting panel 120 with the panel main body 112 of the back panel 110. The front panel 130 is made of an elastic material enabling suppression of occurrence of non-uniformity of stress that causes a crack in the glass plate included in the light-emitting sheet portion 121 when the front panel 130 and the light-emitting panel 120 are integrally curved as described later. Specifically, the elastic material of the front panel 130 is a material having an elastic modulus of 100 GPa or more. The elastic material is, for example, a leaf spring made of SUS. The front panel 130 is surface-treated by, for example, electrodeposition coating or plating.

Figure 8:
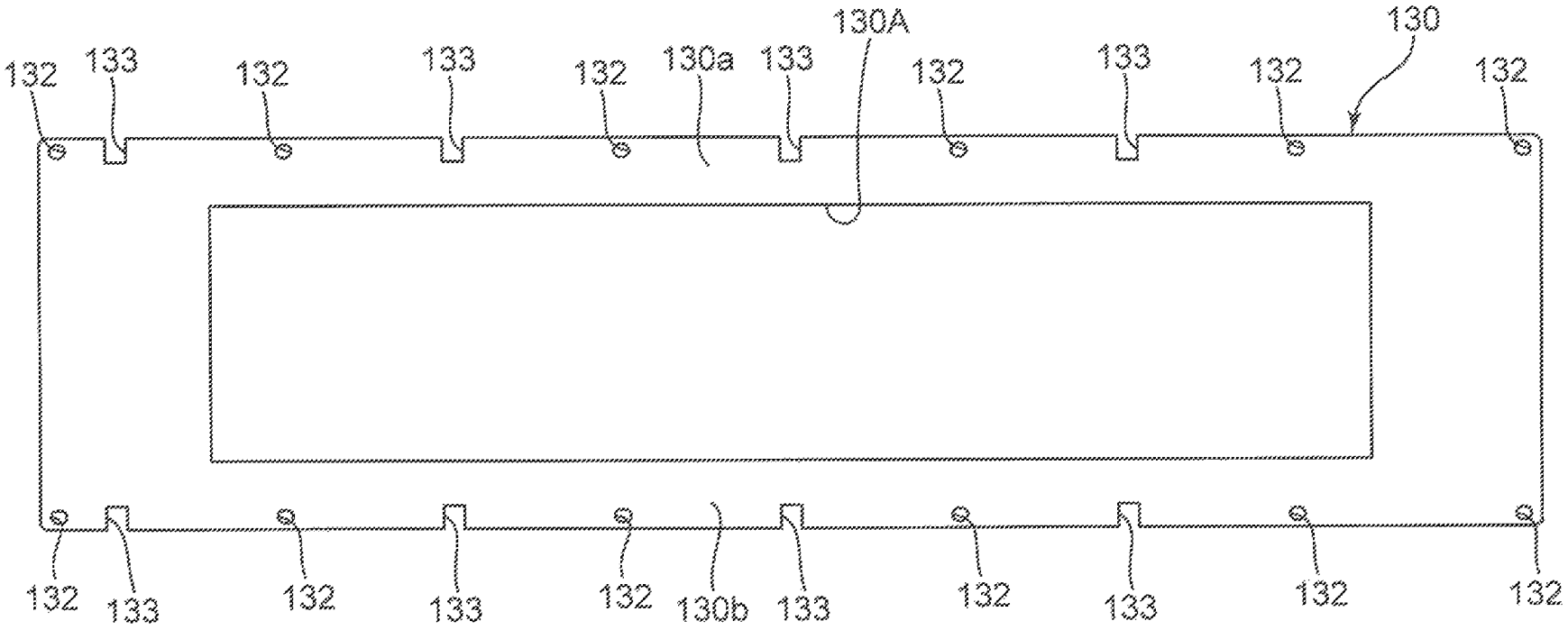
FIG. 8 is a plan view of the front panel of the lighting device according to the first embodiment.

The front panel 130 has a rectangular outer shape larger than that of the light-emitting panel 120 (see FIG. 8). The front panel 130 has a rectangular opening portion 130A penetrating the front panel 130 in a thickness direction. The light-emitting panel 120 (see FIG. 3) is attached to the front panel 130 such that the light-emitting surface 121A of the light-emitting sheet portion 121 is exposed through the opening portion 130A of the front panel 130 and an outer peripheral portion of the front panel 130 protrudes to the outside of the light-emitting panel 120. In a state where the light-emitting panel 120 is attached to the front panel 130 in this manner, the front panel 130 and the light-emitting panel 120 are integrally curved along the panel main body 112, and in this state, the front panel 130 is fastened to the panel main body 112.

The front panel 130 includes a front panel first outer portion 130*a* positioned on one outer side of the light-emitting panel 120 in the width direction of the light-emitting panel 120, and a front panel second outer portion 130*b* positioned on the other outer side of the light-emitting panel 120.

Each of the front panel first outer portion 130*a* and the front panel second outer portion 130*b* is provided with the plurality of front panel screw insertion holes 132 penetrating both the outer portions 130*a* and 130*b* in a thickness direction thereof. The plurality of front panel screw insertion holes 132 provided in the front panel first outer portion 130*a* are disposed at an interval along an extension direction of the front panel 130. Similarly, the plurality of front panel screw insertion holes 132 provided in the front panel second outer portion 130*b* are disposed at an interval along the extension direction of the front panel 130. The extension direction of the front panel 130 corresponds to a length direction of a rectangular outer shape of the front panel 130 when the front panel 130 has a flat plate shape. In addition, the extension direction of the front panel 130 corresponds to a direction along a curved shape of the front panel 130 when the front panel 130 is fastened to the panel main body 112 and curved.

As described above, the plurality of panel fastening screws 118 are inserted through the plurality of front panel screw insertion holes 132 provided in the front panel first outer portion 130*a* and the front panel second outer portion 130*b*, and through the plurality of spacer screw insertion holes 116*a*, and are screwed into the plurality of main body screw holes 113 of the panel main body 112 and fastened, whereby the front panel 130 is fastened to the panel main body 112.

In order to avoid interference between the front panel 130 and respective head portions of the plurality of spacer fastening screws 117 fastening the first spacer portion 116A and the second spacer portion 116B to the panel main body 112, the front panel first outer portion 130*a* and the front panel second outer portion 130*b* are respectively provided with a plurality of screw opening portions 133 opened at respective positions corresponding to the respective head portions of the plurality of spacer fastening screws 117. Each of the plurality of screw opening portions 133 is disposed between the front panel screw insertion holes 132 adjacent to each other in the extension direction of the front panel 130. Each screw opening portion 133 is a notch formed so as to be recessed inward in a width direction of the front panel 130 from an end edge in the width direction. Each screw opening portion 133 is opened outward in the width direction of the front panel 130. The head portion of each of the plurality of spacer fastening screws 117 is disposed in the corresponding screw opening portion 133, thereby avoiding interference between the head portion of each of the plurality of spacer fastening screws 117 and the front panel 130.

Next, a manufacturing process of the lighting device 100 will be described.

First, the curved panel main body 112, and the curved first spacer portion 116A and second spacer portion 116B configured as described above are prepared. Then, the first spacer portion 116A is fastened to the panel main body first outer portion 112*a* by the plurality of spacer fastening screws 117, and the second spacer portion 116B is fastened to the panel main body second outer portion 112*b* by the plurality of spacer fastening screws 117 (see FIG. 3). At this time, the first spacer portion 116A is disposed along a concave surface of the panel main body first outer portion 112*a*. Then, each of the plurality of spacer fastening screws 117 is inserted into the corresponding spacer screw insertion hole 116*a* (see FIG. 4) of the first spacer portion 116A and screwed into the corresponding main body screw hole 113 provided in the panel main body first outer portion 112*a* and fastened, whereby the first spacer portion 116A is fastened to the panel main body first outer portion 112*a*. Similarly, the second spacer portion 116B is disposed along a concave surface of the panel main body second outer portion 112*b*. Then, each of the plurality of spacer fastening screws 117 is inserted into the corresponding spacer screw insertion hole 116*a* of the second spacer portion 116B and screwed into the corresponding main body screw hole 113 provided in the panel main body second outer portion 112*b* and fastened, whereby the second spacer portion 116B is fastened to the panel main body second outer portion 112*b*.

Next, the light-emitting panel 120 and the front panel 130 (see FIG. 2) are prepared. Then, the light-emitting panel 120 and the front panel 130 are aligned such that the light-emitting surface 121A of the light-emitting sheet portion 121 of the light-emitting panel 120 is exposed through the opening portion 130A of the front panel 130, and the light-emitting panel 120 and the front panel 130 are coupled to each other with an adhesive tape or the like in the aligned state.

Then, as illustrated in FIG. 3, the light-emitting panel 120 and the front panel 130 are integrally curved along the first main surface 112A (the concave surface) of the panel main body 112. Thereafter, the light-emitting panel 120 is disposed between the first spacer portion 116A and the second spacer portion 116B, and in this state, the front panel 130 is fastened to the panel main body 112. Specifically, each of the plurality of panel fastening screws 118 is inserted into the corresponding front panel screw insertion hole 132 and the corresponding spacer screw insertion hole 116*a* provided in the first spacer portion 116A and the second spacer portion 116B, and screwed into the corresponding main body screw hole 113 and fastened, whereby the front panel 130 is fastened to the panel main body 112 in a state where the first spacer portion 116A is placed between the front panel first outer portion 130*a* and the panel main body first outer portion 112*a* and the second spacer portion 116B is placed between the front panel second outer portion 130*b* and the panel main body second outer portion 112*b*. At this time, the head portion of each spacer fastening screw 117 is disposed in each screw opening portion 133 of the front panel 130.

By the above process, the lighting device 100 (see FIG. 1) is completed in which the light-emitting panel 120 is sandwiched between the front panel 130 and the panel main body 112 and held in a predetermined curved shape.

In a case where the thickness of the light-emitting panel 120 is changed, the first spacer portion 116A and the second spacer portion 116B placed between the front panel 130 and the panel main body 112 are changed to have thicknesses corresponding to the changed thickness of the light-emitting panel 120. Specifically, at the time of preparing the first spacer portion 116A and the second spacer portion 116B described above, the first spacer portion 116A and the second spacer portion 116B having thicknesses corresponding to the changed thickness of the light-emitting panel 120 are prepared, the first spacer portion 116A is fastened to the panel main body first outer portion 112*a* by the spacer fastening screw 117, and the second spacer portion 116B is fastened to the panel main body second outer portion 112*b* by the spacer fastening screw 117. As a result, when the front panel 130 is thereafter fastened to the panel main body 112 by the panel fastening screw 118 as described above, a gap corresponding to the changed thickness of the light-emitting panel 120 is formed between the front panel 130 and the panel main body 112 by the first spacer portion 116A and the second spacer portion 116B, so that it is possible to cope with a change in the thickness of the light-emitting panel 120.

As described above, in the back panel 110 for a lighting device according to the first embodiment, a size of the gap between the front panel 130 and the panel main body 112 can be arbitrarily set. Therefore, the gap between the front panel 130 and the panel main body 112 can be appropriately set to a size corresponding to the thickness of the light-emitting panel 120 at the time of holding the light-emitting panel. Therefore, it is possible to flexibly cope with the thickness change of the light-emitting panel 120.

Specifically, in the first embodiment, the first spacer portion 116A and the second spacer portion 116B are detachable between the front panel 130 and the panel main body 112, the first spacer portion 116A and the second spacer portion 116B being placed between the front panel 130 and the panel main body 112 at the time of holding the light-emitting panel and form a gap, between the front panel 130 and the panel main body 112, for housing the light-emitting panel 120. Therefore, when the thickness of the light-emitting panel 120 is changed, the gap between the front panel 130 and the panel main body 112 can be adjusted to a size corresponding to the thickness of the light-emitting panel 120 by changing the first spacer portion 116A and the second spacer portion 116B to those having thicknesses corresponding to the thickness of the light-emitting panel 120. Moreover, since the first spacer portion 116A and the second spacer portion 116B are detachable between the front panel 130 and the panel main body 112 as described above, it is possible to cope with the change in the thickness of the light-emitting panel 120 by changing only the first spacer portion 116A and the second spacer portion 116B to those having the thicknesses corresponding to the thickness of the light-emitting panel 120 while using other members than the first spacer portion 116A and the second spacer portion 116B in the back panel 110 as they are. Therefore, it is possible to cope with a thickness change of the light-emitting panel 120 at low cost.

In the first embodiment, the first spacer portion 116A is placed between the front panel 130 and the panel main body 112 over the entire extension direction of the light-emitting panel 120 on one outer side in the width direction of the light-emitting panel 120 at the time of holding the light-emitting panel, and the second spacer portion 116B is placed between the front panel 130 and the panel main body 112 over the entire extension direction of the light-emitting panel 120 at a position opposite to the first spacer portion 116A in the width direction of the light-emitting panel 120 at the time of holding the light-emitting panel. In a case where the first spacer portion 116A and the second spacer portion 116B are not partially provided at any position in the extension direction of the light-emitting panel 120, when the front panel 130 is pressed at that position from the outside opposite to the light-emitting panel 120, the front panel 130 might be deformed to damage the light-emitting panel 120. However, in the first embodiment, since the first spacer portion 116A and the second spacer portion 116B extend over the entire extension direction of the light-emitting panel 120 on both sides in the width direction of the light-emitting panel 120, it is possible to more effectively suppress deformation of the front panel 130 against the pressing described above and to more effectively prevent damage of the light-emitting panel 120.

In the first embodiment, the light-emitting panel 120 can be held by disposing the light-emitting panel 120 along the first main surface 112A of the panel main body 112 with the front panel 130 separated from the panel main body 112 to which the first spacer portion 116A and the second spacer portion 116B are attached at the time of holding the light-emitting panel, sandwiching the light-emitting panel 120 between the front panel 130 and the panel main body 112, and fastening the front panel 130 to the panel main body 112 with the plurality of panel fastening screws 118. Therefore, as compared with a conventional back panel for a lighting device in which both end portions in a width direction of a light-emitting panel are slid along an extension direction of the light-emitting panel and inserted into grooves at both end portions in a width direction of the back panel to hold the light-emitting panel in the back panel, the work of allowing the back panel 110 to hold the light-emitting panel 120 is facilitated, and damage to the light-emitting panel can be avoided that may occur when an end portion of the light-emitting panel is slid and inserted into the groove of the back panel in the conventional back panel for a lighting device.

In the lighting device 100 according to the first embodiment, since the back panel 110 is adopted, the size of the gap between the front panel 130 and the panel main body 112 can be adjusted by changing the thickness of the spacer 116 according to the thickness of the light-emitting panel 120. Therefore, the light-emitting panel 120 can be more reliably brought into contact with the panel main body 112. As a result, heat dissipation effect from the light-emitting panel 120 to the back panel 110 can be further enhanced.

In the first embodiment, when the front panel 130 is held by the front panel holding portion 114, and the front panel 130 and the light-emitting panel 120 are caused to be curved along the first main surface 112A that is the concave surface of the panel main body 112, the light-emitting panel 120 having flexibility can be curved integrally with the front panel 130 made of an elastic material. Although the light-emitting panel 120 has flexibility, because of inclusion of a thin glass plate, in a case of curving the light-emitting panel 120 as described above, when large bending deformation locally occurs and stress is concentrated, the glass plate included in the light-emitting panel 120 might be cracked. For coping with the problem, in the first embodiment, by integrally curving the light-emitting panel 120 having flexibility and the front panel 130 made of an elastic material as described above, it is possible to avoid local bending deformation of the light-emitting panel 120 by the elasticity of the front panel 130. Therefore, it is possible to suppress occurrence of cracking due to stress concentration on the glass plate included in the light-emitting panel 120.

In the first embodiment, the front panel holding portion 114 has the plurality of spacer fastening screws 117 that fasten the first spacer portion 116A and the second spacer portion 116B to the panel main body 112, and the front panel 130 has the plurality of screw opening portions 133 opened such that the head portions of the plurality of spacer fastening screws 117 are disposed inside. Therefore, in the first embodiment, while realizing the configuration in which the first spacer portion 116A and the second spacer portion 116B are separably attached to the panel main body 112 by the plurality of spacer fastening screws 117, the head portions of the spacer fastening screws 117 are disposed in the corresponding screw opening portions 133 of the front panel 130, whereby interference between the head portions of the spacer fastening screws 117 and the front panel 130 can be avoided.

Second Embodiment

Figure 9:
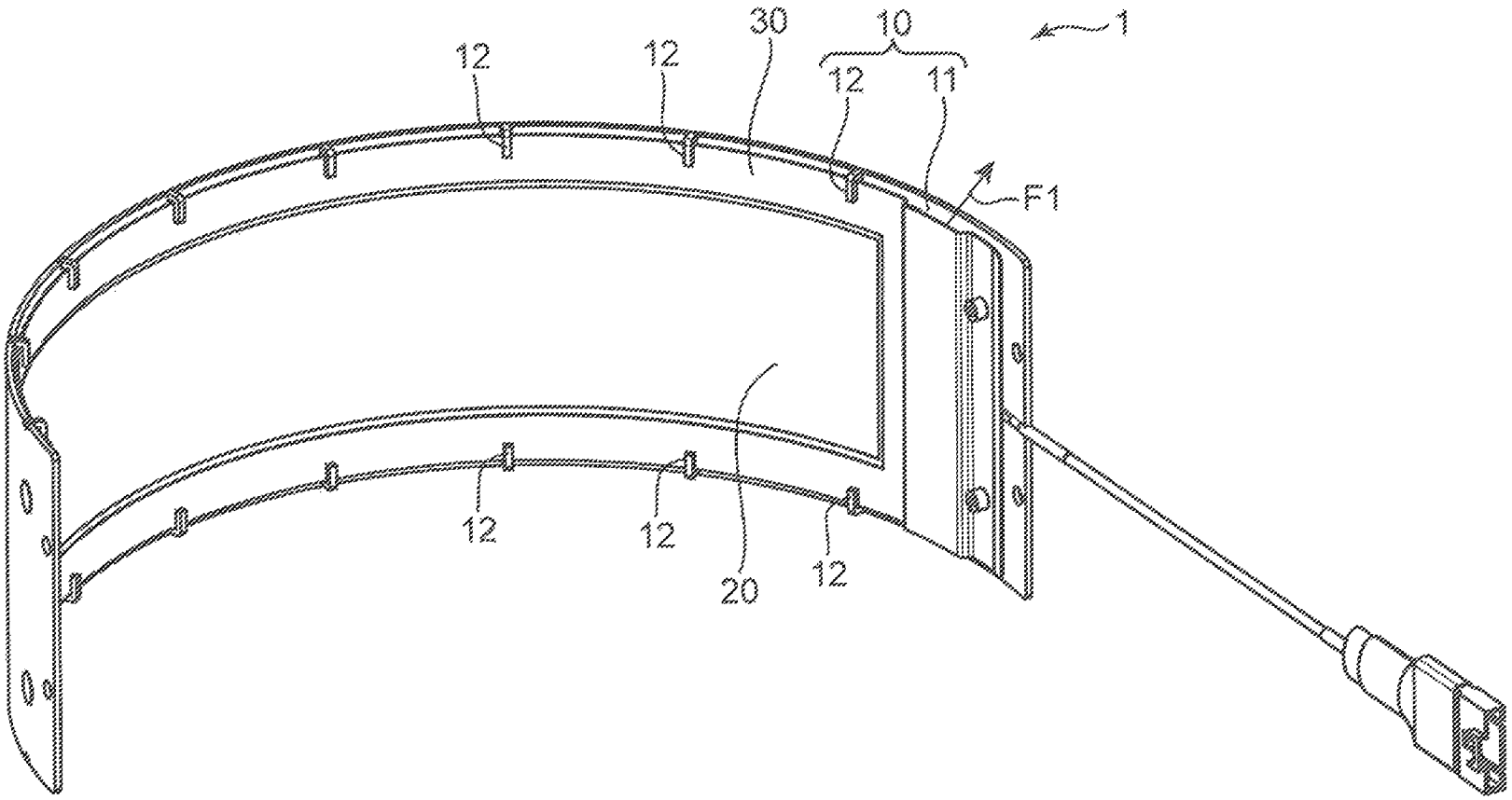
FIG. 9 is a perspective view schematically illustrating a configuration of a lighting device according to a second embodiment of the present invention.
Figure 10:
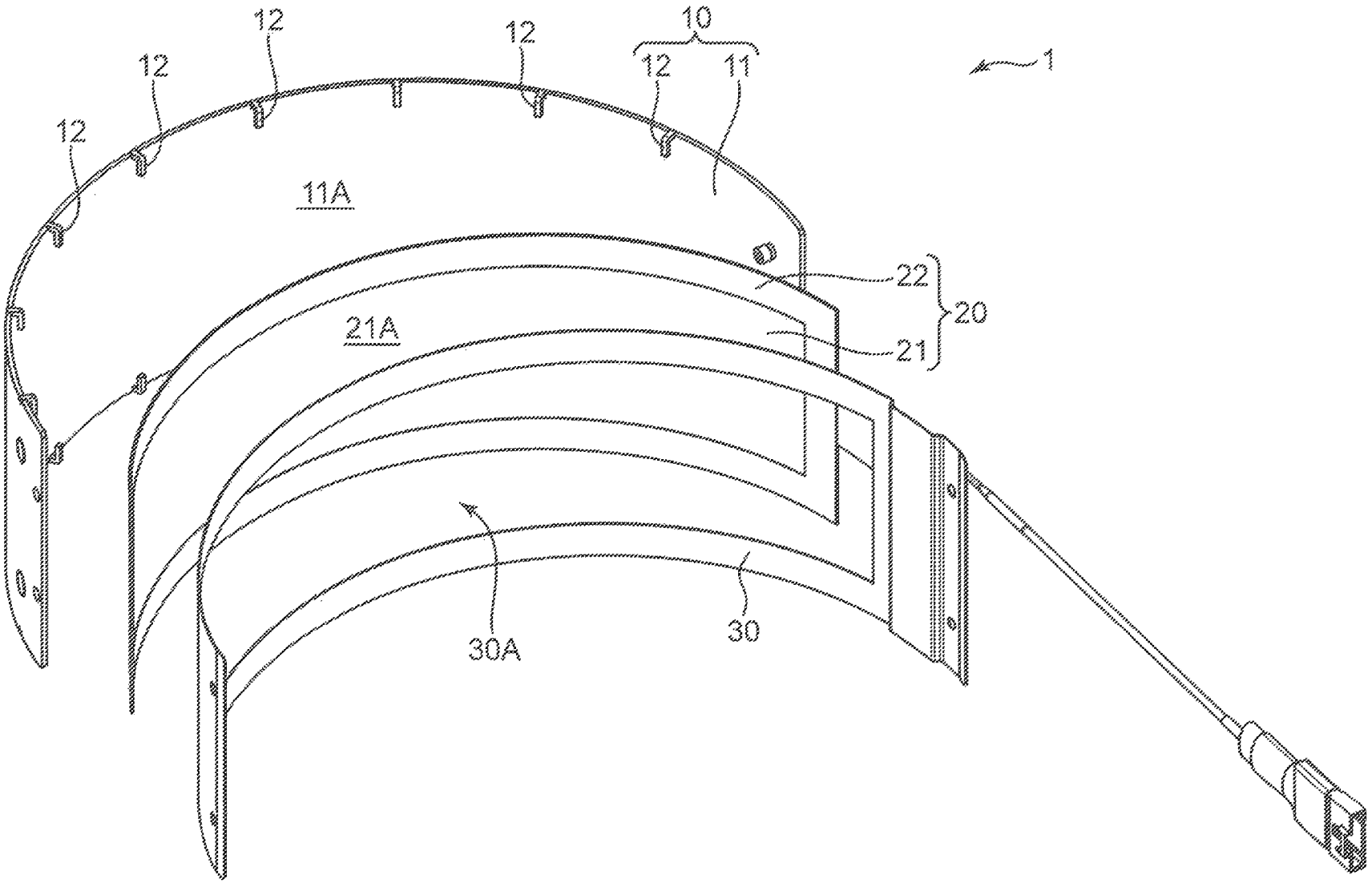
FIG. 10 is an exploded perspective view of the lighting device according to the second embodiment.

First, a configuration of a back panel 10 for a lighting device (hereinafter, also simply referred to as a "back panel 10") according to a second embodiment of the present invention will be described with reference to FIG. 9 to FIG. 11. FIG. 9 is a perspective view schematically illustrating a lighting device 1 in which the back panel 10 according to the second embodiment is incorporated. FIG. 10 is an exploded perspective view of the lighting device 1 according to the second embodiment.

As illustrated in FIG. 10, the back panel 10 is adapted for sandwiching and holding a light-emitting panel 20 for lighting with a front panel 30. The back panel 10 is incorporated in the lighting device 1 in a state of being curved in an arc shape. The back panel 10 is made of, for example, an aluminum plate. The back panel 10 is capable of maintaining a constant curvature in a curved state as illustrated in FIG. 10. Although in the second embodiment, the back panel 10 made of aluminum is adopted in consideration of heat dissipation, the material of the back panel is not limited thereto.

Figure 11:
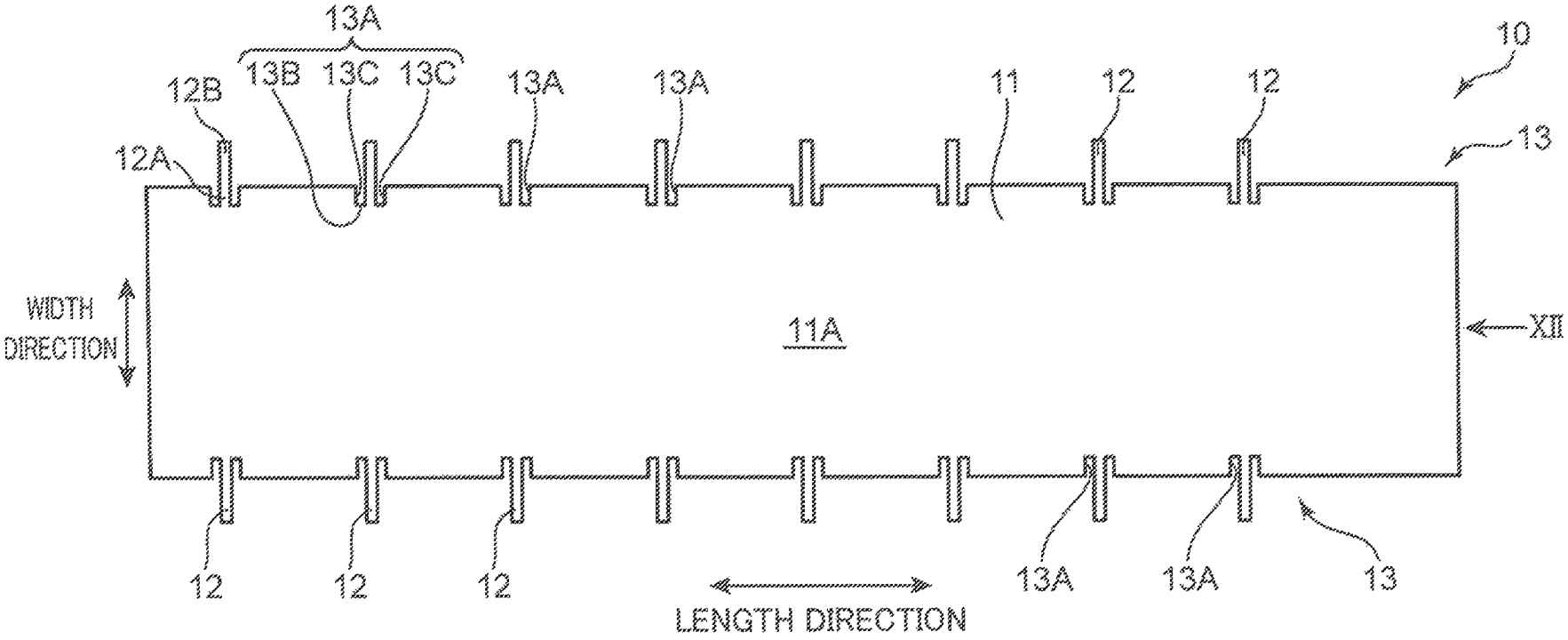
FIG. 11 is a plan view schematically illustrating a configuration of a back panel for a lighting device according to the second embodiment of the present invention.

FIG. 11 is a plan view schematically illustrating a configuration of the back panel 10 in a flat plate state before curving. As illustrated in FIG. 11, the back panel 10 includes a panel main body 11 formed of a rectangular plate in plan view, and a plurality of claw portions 12 protruding outward in a width direction from end portions 13 of the panel main body 11 in the width direction.

The panel main body 11 has a first main surface 11A on which the light-emitting panel 20 (FIG. 10) is to be disposed and a second main surface 11B (FIG. 12) facing the side opposite to the first main surface 11A.

Notch portions 13A recessed inward in the width direction are formed at the end portions 13 in the width direction of the panel main body 11. As illustrated in FIG. 11, the notch portion 13A is a groove portion opened outward in the width direction. The notch portion 13A is defined by a pair of groove wall surfaces 13C and a groove bottom surface 13B (bottom portion). The groove wall surfaces 13C extend in the width direction and face each other with an interval therebetween in a length direction. The groove bottom surface 13B extends in the length direction and connects inner end portions of the groove wall surfaces 13C to each other.

In the second embodiment, a plurality of the notch portions 13A are formed at an equal interval in the length direction at the one and the other end portions 13 in the width direction. Although each notch portion 13A is formed in the same shape and size, the shape and size are not limited thereto.

The plurality of claw portions 12 are included in the concept of the front panel holding portion in the present invention. The plurality of claw portions 12 hold the front panel 30 at positions where the front panel 30 sandwiches the light-emitting panel 20 with the panel main body 11. Each claw portion 12 protrudes outward in the width direction from the groove bottom surface 13B of the notch portion 13A. More specifically, as illustrated in FIG. 11, each claw portion 12 has a proximal end 12A connected to the groove bottom surface 13B and a distal end 12B positioned outside the end portion 13 of the panel main body 11 in the width direction. Each claw portion 12 extends from the proximal end 12A toward the distal end 12B. Further, there is a slight gap between both side surfaces of the claw portion 12 and the groove wall surfaces 13C facing the side surfaces. Therefore, the side surface of the claw portion 12 and the groove wall surface 13C facing the side surface are not in contact with each other.

One claw portion 12 is provided for each notch portion 13A. For this reason, in the second embodiment, the plurality of claw portions 12 are provided at an equal interval in the length direction at the one and the other end portions 13 in the width direction, respectively. The notch portion 13A and the claw portion 12 are formed by laser processing of a flat plate having a rectangular shape in plan view. Shapes of the notch portion 13A and the claw portion 12 are not particularly limited.

Figure 12:
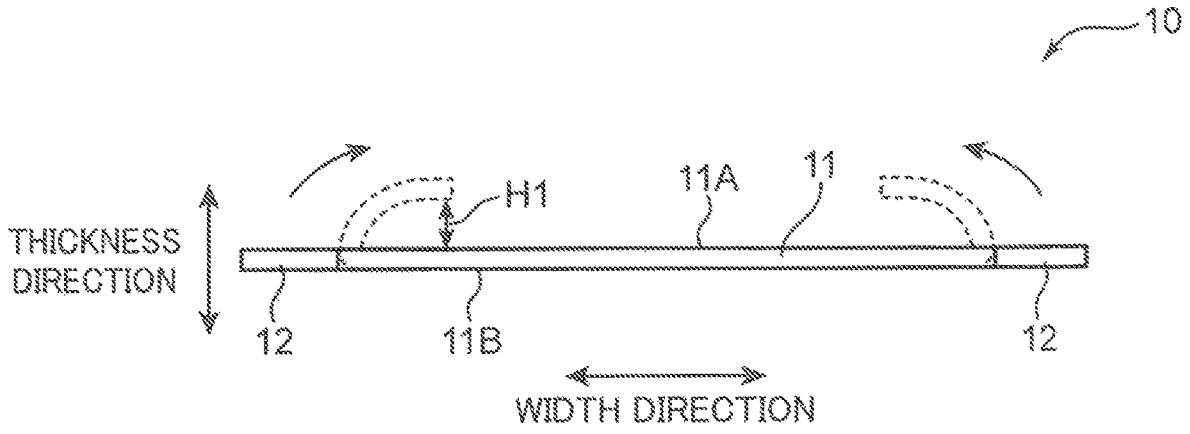
FIG. 12 is a schematic view illustrating bending of a claw portion in the back panel for a lighting device according to the second embodiment.

The claw portion 12 is a portion for holding the light-emitting panel 20 and the front panel 30 with respect to the panel main body 11 (FIG. 9). The claw portion 12 is configured to be bendable inward in the width direction of the panel main body 11. FIG. 12 is a side view of the back panel 10 as viewed from a direction of an arrow XII in FIG. 11. As indicated by a broken line in FIG. 12, the claw portion 12 can be bent inward in the width direction of the panel main body 11 around a connection portion (the proximal end 12A, FIG. 11) with the panel main body 11. At this time, a height H1 of a gap between the claw portion 12 and the first main surface 11A can be adjusted by a bending angle of the claw portion 12. Although in FIG. 12, the claw portion 12 is bent so as to face the first main surface 11A, the claw portion 12 can be also bent so as to face the second main surface 11B.

Next, a configuration of the lighting device 1 according to the second embodiment of the present invention will be described with reference to FIG. 9 and FIG. 10. The lighting device 1 uses an OLED as a light source. The lighting device 1 has a curved shape. The lighting device 1 is used for appearance inspection of various cylindrical bodies and chemical ampoules. The lighting device 1 includes the back panel 10, the light-emitting panel 20, and the front panel 30.

As illustrated in FIG. 10, in the back panel 10 according to the second embodiment, the claw portion 12 is bent inward in the width direction with the gap from the first main surface 11A of the panel main body 11, and the panel main body 11 is curved in an arc shape such that the first main surface 11A becomes a concave surface. Both end portions in the width direction of the light-emitting panel 20 and the front panel 30 are inserted into the gaps. A curvature radius of the panel main body 11 is not particularly limited, and can be appropriately set according to an application of the lighting device 1, or the like.

The light-emitting panel 20 is an OLED panel. The light-emitting panel 20 is a rectangular thin panel one size smaller than the back panel 10. The light-emitting panel 20 is bendable. As illustrated in FIG. 10, the light-emitting panel 20 is curved in an arc shape along the first main surface 11A of the panel main body 11.

More specifically, the light-emitting panel 20 includes a light-emitting sheet portion 21 and a cover portion 22 that covers an edge portion of the light-emitting sheet portion 21. The light-emitting sheet portion 21 has a multilayer structure in which a light emitting layer, an electrode, and the like are laminated on a thin glass plate. The light-emitting sheet portion 21 has a light-emitting surface 21A. Although an emission color is, for example, white, the color is not particularly limited. The light-emitting sheet portion 21 may be formed by further laminating, for example, a diffusion plate, a polarizing plate, an LC film, or a color filter.

Figure 13:
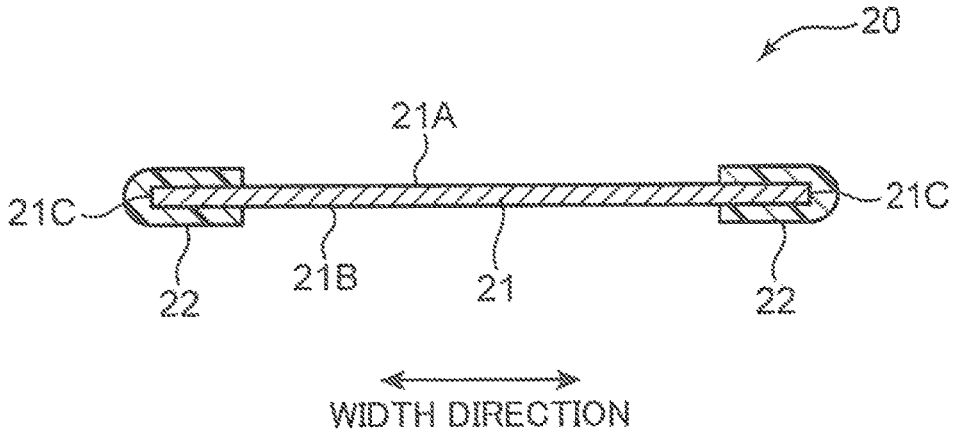
FIG. 13 is a cross-sectional view illustrating a configuration of a light-emitting panel.

The cover portion 22 is a film having a light shielding property and an electrical insulation property. For example, a black vinyl tape or the like can be used for the cover portion 22. FIG. 13 illustrates a cross-section taken along a width direction of the light-emitting panel 20. As illustrated in FIG. 13, the cover portion 22 is attached to the entire edge portion of the light-emitting sheet portion 21 (along the four sides of the light-emitting sheet portion 21) so as to cover an edge portion of a front surface of the light-emitting sheet portion 21, an edge portion of a back surface 21B of the light-emitting sheet portion 21, and a side surface 21C of the light-emitting sheet portion 21. The front surface of the light-emitting sheet portion 21 is a surface including the light-emitting surface 21A. The side surface 21C is a surface connecting the front surface and the back surface 21B. When viewed from the front surface side of the light-emitting sheet portion 21, the cover portion 22 is provided so as to surround the entire periphery of the light-emitting surface 21A. By providing the cover portion 22, light leakage from the edge portions of the front and back surfaces and from side surfaces of the light-emitting sheet portion 21 can be suppressed, and electrical insulation between the electrode of the light-emitting sheet portion 21 and the front panel 30 and the back panel 10 can be more reliably ensured. Further, cracking of the glass plate of the light-emitting sheet portion 21 can be also suppressed.

The front panel 30 is adapted for sandwiching the light-emitting panel 20 with the back panel 10. The front panel 30 is made of an elastic material such as a leaf spring made of SUS, for example. The front panel 30 is curved along the light-emitting panel 20. The front panel 30 is held, in the curved state, on the back panel 10 together with the light-emitting panel 20 by the claw portion 12. The front panel 30 has a rectangular shape smaller than the back panel 10 and larger than the light-emitting panel 20. An opening portion 30A for exposing the light-emitting surface 21A is formed in the front panel 30. The front panel 30 is surface-treated by, for example, electrodeposition coating or plating.

The light-emitting panel 20 is pressed against the first main surface 11A (concave surface) of the back panel 10 by a reaction force accompanying the curvature of the front panel 30. Specifically, since the front panel 30 is made of an elastic material, a reaction force F1 (FIG. 9) to return from the curved state to a flat plate state is generated. The reaction force F1 pushes the light-emitting panel 20 toward the back panel 10 side. In the second embodiment, since the front panel 30 is curved such that a substantially central portion in a length direction becomes a top portion, the reaction force F1 acts more greatly as it goes away in the length direction from the central portion.

Next, a manufacturing process of the lighting device 1 will be described.

Figure 14:
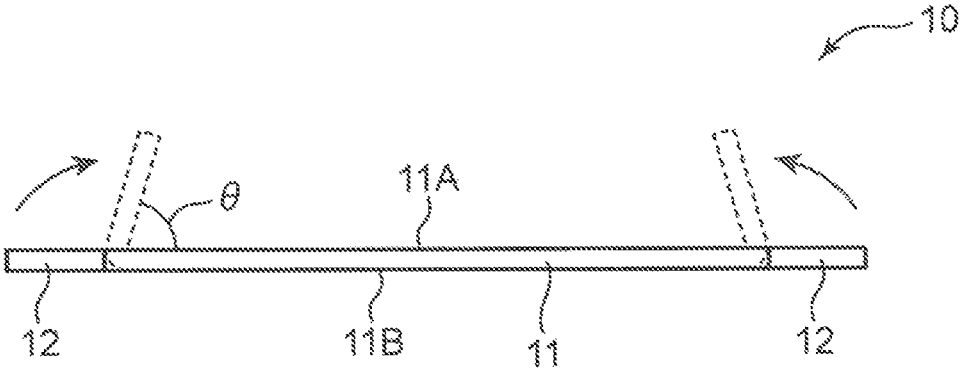
FIG. 14 is a schematic view illustrating a step of erecting the claw portion of the back panel in a manufacturing process of the lighting device according to the second embodiment.

First, the back panel 10 is manufactured by the following procedure. First, an aluminum flat plate (not illustrated) having a rectangular shape in plan view is prepared, and an outer shape of the flat plate is processed by laser as shown in FIG. 11. Next, the claw portion 12 is hit by a hammer (not illustrated) or the like, and the claw portion 12 is raised at a predetermined angle θ with respect to the panel main body 11 as indicated by a broken line in FIG. 14.

Figure 15:
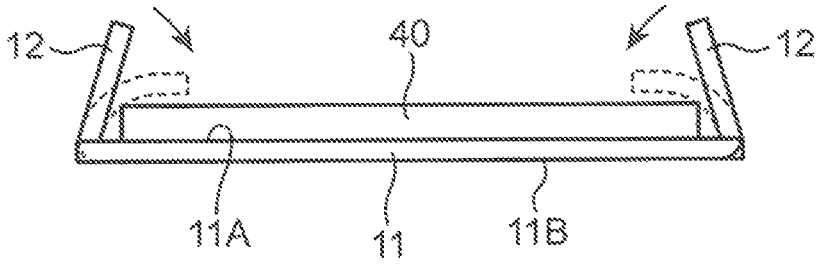
FIG. 15 is a schematic view illustrating a step of bending the claw portion of the back panel in the manufacturing process of the lighting device according to the second embodiment.

Next, the back panel 10 is set on a jig (not illustrated), and a height adjusting plate 40 is disposed on the first main surface 11A of the panel main body 11 as illustrated in FIG. 15. As the height adjusting plate, a plate having a thickness corresponding to a total thickness of the light-emitting panel 20 and the front panel 30 is used. In this state, as indicated by a broken line in FIG. 15, the claw portion 12 is bent radially inward along an upper surface of the height adjusting plate 40. Thereafter, the height adjusting plate 40 is removed. By the above-described manner, claw processing of the back panel 10 is completed.

Figure 16:
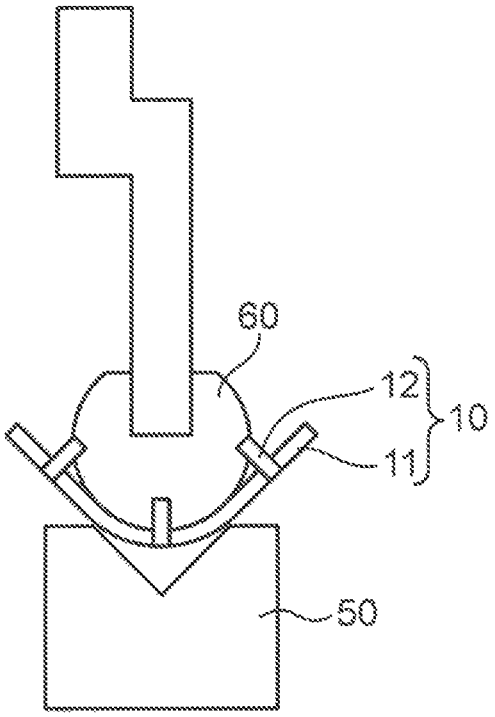
FIG. 16 is a schematic view illustrating bending of the back panel in the manufacturing process of the lighting device according to the second embodiment.

Next, bending of the back panel 10 is performed. As illustrated in FIG. 16, the back panel 10 after the claw processing is placed on a die 50. Then, the back panel 10 is conveyed in the length direction at a predetermined pitch to pass between the die 50 and a curved punch 60. As a result, the back panel 10 is curved with a predetermined curvature radius, and processing of the back panel 10 is completed.

Next, the light-emitting panel 20 and the front panel 30 are prepared. Then, these panels are disposed along the concave surface (the first main surface 11A) of the back panel 10, and both end portions thereof in the width direction are held by the claw portions 12. Specifically, the light-emitting panel 20 and the front panel 30 are overlapped and inserted into the gap between the claw portion 12 and the panel main body 11 from one end in the length direction. As a result, the lighting device 1 (FIG. 9) in which the light-emitting panel 20 is sandwiched by the front panel 30 and the back panel 10 is completed.

As described above, according to the back panel 10 for a lighting device according to the second embodiment, the size of the gap between the claw portion 12 and the panel main body 11 can be adjusted by adjusting the bending angle and the like of the claw portion 12 according to the thickness of the light-emitting panel 20. Therefore, it is possible to flexibly cope with the thickness change of the light-emitting panel 20. This enables the light-emitting panel 20 to be more reliably brought into contact with the concave surface of the back panel 10, and as a result, the heat dissipation effect from the light-emitting panel 20 to the back panel 10 can be further enhanced.

Third Embodiment

Next, a configuration of a lighting device 2 according to a third embodiment of the present invention will be described with reference to FIG. 17. Although the third embodiment is basically the same as the second embodiment, it is different in that the light-emitting panel 20 and the front panel 30 are disposed on a convex surface side of the back panel 10. Hereinafter, only differences from the second embodiment in the configurations of the back panel 10 and the lighting device 2 according to the third embodiment will be described.

Figure 17:
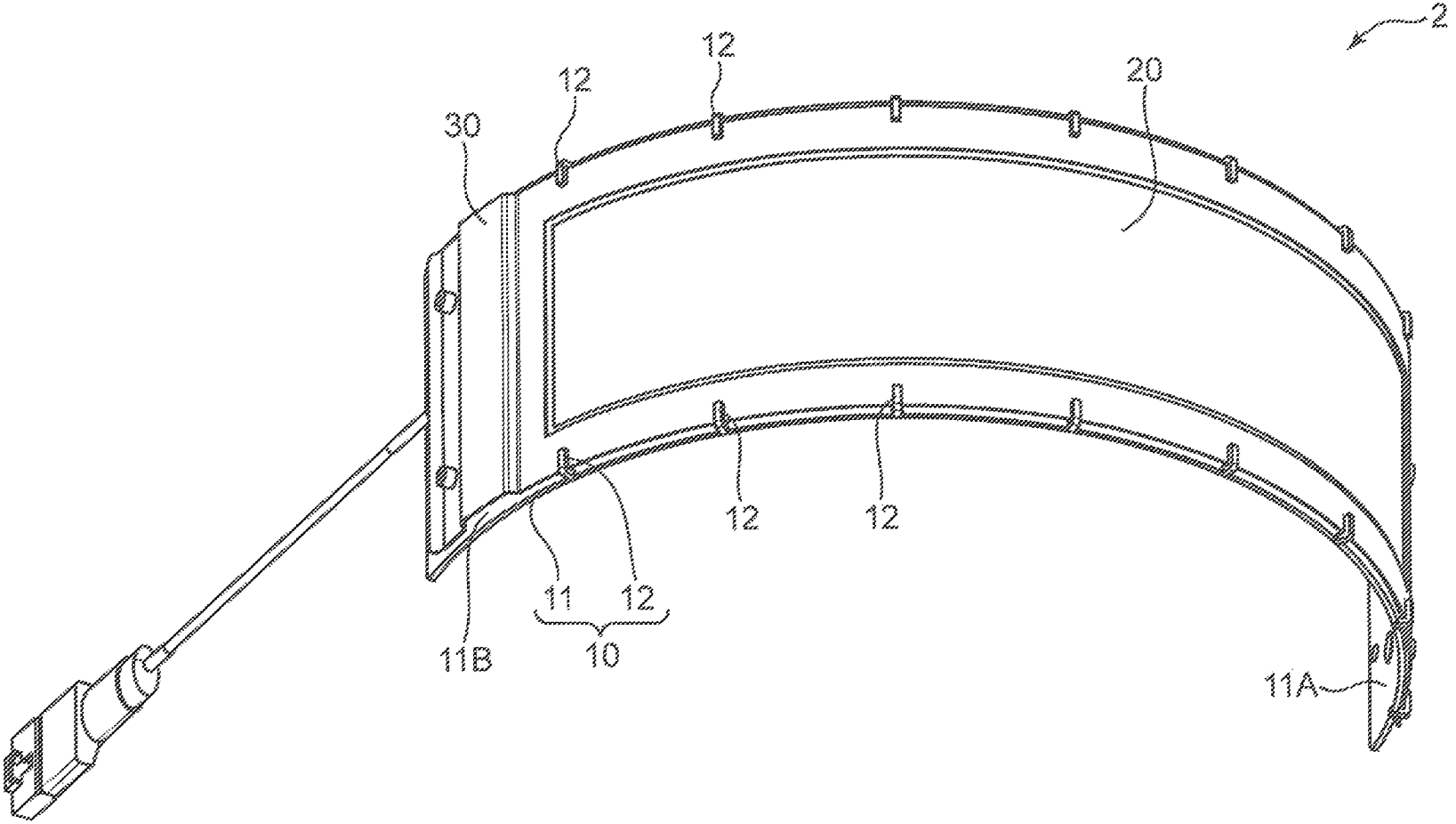
FIG. 17 is a perspective view schematically illustrating a configuration of a lighting device according to a third embodiment of the present invention.

As illustrated in FIG. 17, in the third embodiment, the claw portion 12 is bent inward in the width direction so as to face the convex surface (the second main surface 11B) of the panel main body 11. The light-emitting panel 20 and the front panel 30 are curved along the second main surface 11B of the panel main body 11. The light-emitting panel 20 and the front panel 30 are held by the back panel 10 by means of the claw portions 12 similarly to the second embodiment.

As described above, the claw portion 12 of the back panel 10 can be bent not only toward the first main surface 11A side but also toward the second main surface 11B side. Therefore, not only the lighting device 1 in which the light-emitting panel 20 is disposed on the concave surface of the back panel 10 but also the lighting device 2 in which the light-emitting panel 20 is disposed on the convex surface of the back panel 10 can be manufactured using the same back panel 10.

Fourth Embodiment

Next, a configuration of a back panel 3 for a lighting device according to a fourth embodiment of the present invention will be described with reference to FIG. 18. Although the back panel 3 according to the fourth embodiment is basically the same as the back panel 10 according to the second embodiment, it differs from the back panel 10 according to the second embodiment in a pitch of the claw portions 12. Hereinafter, in a configuration of the back panel 3 according to the fourth embodiment, only differences from the back panel 3 according to the second embodiment will be described.

Figure 18:
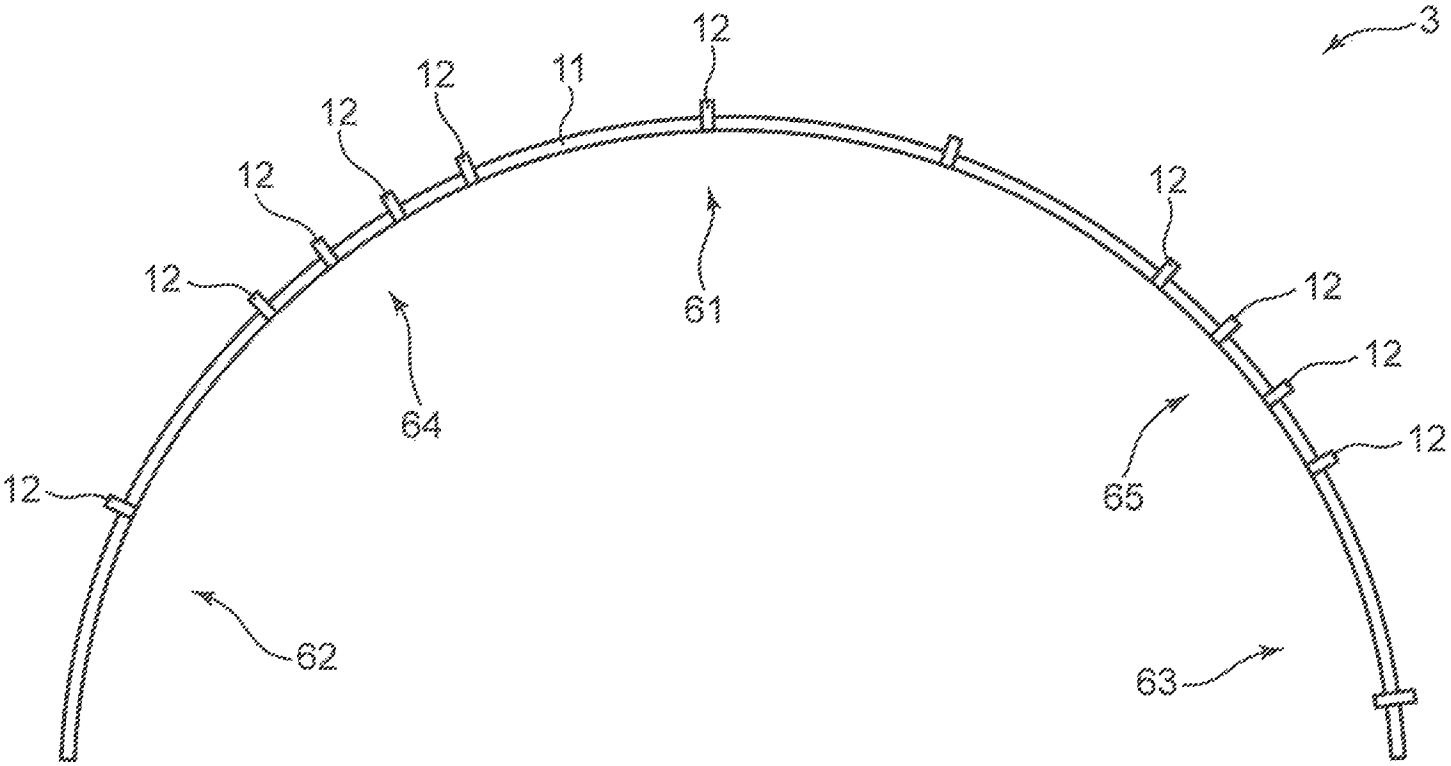
FIG. 18 is a schematic view illustrating a configuration of a back panel for a lighting device according to a fourth embodiment of the present invention.

FIG. 18 schematically illustrates an arrangement of the claw portions 12 in the back panel 3 according to the fourth embodiment. As illustrated in FIG. 18, the back panel 3 according to the fourth embodiment is a curved portion as a whole. The back panel 3 according to the fourth embodiment includes a central portion 61 in a length direction of the back panel 3, a first end portion 62 and a second end portion 63, a first intermediate portion 64, and a second intermediate portion 65 in the same length direction. The first intermediate portion 64 is a portion located between the central portion 61 and the first end portion 62. The second intermediate portion 65 is a portion located between the central portion 61 and the second end portion 63. The claw portion 12 has a pitch narrower in the first intermediate portion 64 and the second intermediate portion 65 of the curved portion than in the central portion 61 and both end portions of the curved portion of the panel main body 11 in the length direction. That is, in the first intermediate portion 64 and the second intermediate portion 65, the interval between the claw portions 12 adjacent to each other in the length direction is narrower than that in the central portion 61, the first end portion 62, and the second end portion 63. In other words, in the first intermediate portion 64 and the second intermediate portion 65, the claw portions 12 are formed more densely than in the central portion 61, the first end portion 62, and the second end portion 63.

According to the consideration by the present inventors, it has been found that when the light-emitting panel 20 is disposed along the curved back panel 10, the light-emitting panel 20 is easily separated from the main surface of the back panel 10 in the first intermediate portion 64 and the second intermediate portion 65. For coping with the problem, by providing the claw portions 12 more densely in the first intermediate portion 64 and the second intermediate portion 65, the light-emitting panel 20 can be more firmly held with respect to the back panel 10, and as a result, the gap between the light-emitting panel 20 and the back panel 10 can be suppressed from widening. As a result, the heat dissipation effect from the light-emitting panel 20 to the back panel 10 can be further enhanced.

Note that the present invention is not limited to the case of providing the claw portions 12 sparsely or densely when the claw portion 12 is folded toward the concave surface side of the back panel 10, and the claw portions 12 may be provided sparsely or densely as in the fourth embodiment in a case where the claw portion 12 is folded toward the convex surface side of the back panel 10.

Other Embodiments

Here, other embodiments of the present invention will be described.

Although in the first to fourth embodiments, the description has been made of the case where the entire back panel 110, 10, and 3 is curved in an arc shape, the shape of the back panel in the present invention is not limited thereto. For example, the back panel may be curved in an S shape, or may include a curved portion and a flat plate portion. The present invention is not limited to the case where the back panel includes a curved portion, and the entire back panel may have a flat plate shape.

Although in the first embodiment, the first spacer portion 116A and the second spacer portion 116B of the back panel 110 extend over the entire extension direction of the light-emitting panel 120, the spacer in the present invention is not limited thereto.

For example, the spacer may be divided into a plurality of spacers in the extension direction thereof, and the plurality of divided spacers may be provided at an interval along the extension direction of the light-emitting panel. In this case, the divided spacers are preferably provided at positions corresponding to the panel fastening screws for fastening the front panel to the panel main body.

The spacer may be provided for each panel fastening screw between the front panel and the panel main body, and may have a tubular shape through which each panel fastening screw is inserted.

The spacer may be disposed so as to surround the entire circumference of the light-emitting panel between the front panel and the panel main body. The spacer may be disposed between the front panel and the panel main body so as to surround three sides excluding the cable side of the light-emitting panel.

Although in the first embodiment, the first spacer portion 116A and the second spacer portion 116B are fastened to the panel main body 112 by the spacer fastening screw 117, the configuration of the present invention is not necessarily limited to the configuration in which the spacer is fastened to the panel main body by the spacer fastening screw. For example, the spacer may be fastened only by fastening the spacer to the panel main body together with the front panel by means of the panel fastening screw. In other words, fastening of the spacer alone to the panel main body by the spacer fastening screw may be omitted. The spacer may be fixed between the front panel and the panel main body simply by being sandwiched between the front panel and the panel main body. In other words, the fastening of the spacer by the screw may be omitted.

In the back panel in which the spacer forms a gap between the front panel and the panel main body, and the lighting device, the light-emitting panel and the front panel may be disposed on the convex surface side of the panel main body and curved along the convex surface as in the third embodiment. In this case, it need only that the spacer has a curved shape along the convex surface of the panel main body, and is installed on the convex surface of the panel main body. For example, the first spacer portion 116A and the second spacer portion 116B in the first embodiment may be curved in the opposite direction to have a shape along the convex surface of the panel main body.

It should be understood that the embodiments disclosed herein are illustrative in all respects and are not restrictive. The scope of the present invention is indicated not by the above description but by the claims, and it is intended that meanings equivalent to the claims and all modifications within the scope are included.

Summary of Embodiments

The above embodiments are summarized as follows.

The back panel for a lighting device according to the embodiment is adapted for sandwiching and holding a light-emitting panel for lighting with a front panel. The back panel for a lighting device includes: a panel main body disposed along a back surface on a side opposite to a light-emitting surface of the light-emitting panel at a time of holding the light-emitting panel, the time when the light-emitting panel is held by the back panel for a lighting device; and a front panel holding portion that holds the front panel at a position where the front panel sandwiches the light-emitting panel with the panel main body at the time of holding the light-emitting panel. The front panel holding portion has a configuration capable of setting a size of a gap between the front panel held by the front panel holding portion and the panel main body to an arbitrary size.

In the back panel for a lighting device, since the front panel holding portion has a configuration capable of setting a size of the gap between the front panel held by the front panel holding portion and the panel main body to an arbitrary size, the gap between the front panel and the panel main body can be appropriately set to a size corresponding to a thickness of the light-emitting panel at the time of holding the light-emitting panel. Therefore, it is possible to flexibly cope with a thickness change of the light-emitting panel.

The front panel holding portion includes a spacer that is placed between the front panel and the panel main body to form a gap that houses the light-emitting panel between the front panel and the panel main body at the time of holding the light-emitting panel, and the spacer is separably attached to the panel main body.

In this configuration, the spacer is separably attached to the panel main body, the spacer placed between the front panel and the panel main body to form a gap that houses the light-emitting panel between the front panel and the panel main body at the time of holding the light-emitting panel. Therefore, when the thickness of the light-emitting panel is changed, it is possible to cope with the change in the thickness of the light-emitting panel by changing only the spacer to one having a thickness corresponding to the thickness of the light-emitting panel while using the members other than the spacer in the back panel as they are. It is accordingly possible to obtain a back panel capable of coping with a change in the thickness of the light-emitting panel at low cost.

The spacer preferably includes a first spacer portion extending, on one outer side in a width direction of the light-emitting panel, over the entire extension direction of the light-emitting panel at the time of holding the light-emitting panel, and a second spacer portion extending, at a position opposite to the first spacer portion in the width direction of the light-emitting panel, over the entire extension direction of the light-emitting panel at the time of holding the light-emitting panel.

If the spacer is not partially provided at any position in the extension direction of the light-emitting panel, when the front panel is pressed at that position from the outside opposite to the light-emitting panel, the front panel might be deformed to damage the light-emitting panel. In this configuration, however, since the first spacer portion and the second spacer portion extend over the entire extension direction of the light-emitting panel on both sides in the width direction of the light-emitting panel, the deformation of the front panel can be more effectively suppressed against the pressing described above, and the damage of the light-emitting panel can be more effectively prevented.

The front panel holding portion preferably further includes a panel fastening screw that fastens the front panel to the panel main body in a state where the spacer is placed between the front panel and the panel main body at the time of holding the light-emitting panel.

According to this configuration, at the time of holding the light-emitting panel, the light-emitting panel is disposed along the panel main body in a state where the front panel is separated from the panel main body to which the spacer is attached, the light-emitting panel is sandwiched between the front panel and the panel main body, and the front panel is fastened to the panel main body with the panel fastening screw, whereby the light-emitting panel can be held. Therefore, work for holding the light-emitting panel by the back panel is facilitated as compared with a conventional back panel for a lighting device in which both end portions in a width direction of a light-emitting panel are slid and inserted into grooves at both end portions in a width direction of the back panel along an extension direction of the light-emitting panel to hold the light-emitting panel by the back panel. In addition, it is possible to prevent the light-emitting panel from having a damage that might occur when the end portion of the light-emitting panel is slid and inserted into the groove of the back panel.

The lighting device according to the embodiment includes: the back panel for a lighting device in which at least a part of the panel main body is curved; the light-emitting panel curved along one main surface of the panel main body; and the front panel that is held by the front panel holding portion to sandwich the light-emitting panel with the panel main body, the front panel being curved along the light-emitting panel.

According to this lighting device, by adopting the back panel for a lighting device, the size of the gap between the front panel held by the front panel holding portion and the panel main body can be adjusted according to the thickness of the light-emitting panel, so that the light-emitting panel can be more reliably brought into contact with the panel main body. As a result, heat dissipation effect from the light-emitting panel to the back panel can be further enhanced.

The lighting device according to the embodiment includes: the back panel for a lighting device in which the front panel holding portion has the spacer, at least a part of the panel main body being curved; the light-emitting panel curved along one main surface of the panel main body; and the front panel that is held by the front panel holding portion to sandwich the light-emitting panel with the panel main body, the front panel being curved along the light-emitting panel. The front panel holding portion further includes a spacer fastening screw fastening the spacer to the panel main body, and the front panel has a screw opening portion opened such that a head portion of the spacer fastening screw is disposed inside.

According to this lighting device, by adopting the above-described back panel for a lighting device, the size of the gap between the front panel held by the front panel holding portion and the panel main body can be adjusted according to the thickness of the light-emitting panel, so that the light-emitting panel can be more reliably brought into contact with the panel main body. As a result, heat dissipation effect from the light-emitting panel to the back panel can be further enhanced. Further, in this lighting device, the spacer is fastened to the panel main body by the spacer fastening screw, so that it is possible to realize a structure that enables the spacer to be detachable between the front panel and the panel main body. Therefore, the structure for adjusting the gap between the front panel and the panel main body according to a change in the thickness of the light-emitting panel can be embodied. Moreover, in this lighting device, the head portion of the spacer fastening screw is disposed in the screw opening portion of the front panel, so that interference between the head portion of the spacer fastening screw and the front panel can be avoided.

Preferably, the light-emitting panel has flexibility, the front panel is made of an elastic material, and the light-emitting panel and the front panel are coupled to each other and integrally curved along the one main surface.

According to this configuration, when the front panel is held by the front panel holding portion, and the front panel and the light-emitting panel are curved along one main surface of the panel main body, the flexible light-emitting panel can be curved integrally with the front panel made of an elastic material. Although flexible, common light-emitting panels often include a thin glass plate. In this case, when the light-emitting panel is curved as described above, if large bending deformation locally occurs and stress is concentrated, the glass plate included in the light-emitting panel might be cracked. In the present configuration, however, by integrally curving the flexible light-emitting panel and the front panel made of an elastic material as described above, it is possible to avoid occurrence of local bending deformation in the light-emitting panel by the elasticity of the front panel, so that cracking due to stress concentration is suppressed from occurring in the glass plate included in the light-emitting panel.

The front panel holding portion may have a claw portion that holds the front panel at a position where the front panel sandwiches the light-emitting panel with the panel main body at the time of holding the light-emitting panel, the claw portion being configured to protrude outward in a width direction of the panel main body from an end portion of the panel main body in the width direction and to be bendable inward in the width direction.

According to this configuration, the claw portion is bent inward in the width direction of the panel main body, and the front panel and the light-emitting panel are inserted into a gap between the claw portion and the panel main body to hold the front panel by the claw portion, whereby the light-emitting panel is held between the front panel and the panel main body. The size of the gap between the claw portion and the panel main body can be adjusted by a bending angle of the claw portion or the like. Accordingly, according to the configuration, the size of the gap between the claw portion and the panel main body can be appropriately adjusted by adjusting the bending angle of the claw portion or the like according to the thickness of the light-emitting panel. Therefore, it is possible to flexibly cope with a thickness change of the light-emitting panel.

The lighting device according to the embodiment includes: the back panel for a lighting device in which the front panel holding portion has the claw portion, at least a part of the panel main body being curved; the light-emitting panel curved along one main surface of the panel main body; and the front panel that sandwiches the light-emitting panel with the panel main body, the front panel being curved along the light-emitting panel. A plurality of the claw portions are provided at an interval in a length direction of the panel main body, and are bent inward in the width direction with a gap from the panel main body, and end portions of the light-emitting panel and the front panel are inserted into the gap.

According to this lighting device, by adopting the above-described back panel for a lighting device, the gap between the claw portion and the panel main body can be appropriately adjusted according to a total thickness of the light-emitting panel and the front panel, and the light-emitting panel can be more reliably brought into contact with the panel main body. As a result, heat dissipation effect from the light-emitting panel to the back panel can be further enhanced.

The light-emitting panel may be curved along a convex surface of the panel main body.

The light-emitting panel may include a light-emitting sheet portion and a cover portion that covers an edge portion of the light-emitting sheet portion and has a light shielding property and an electrical insulation property.

According to this configuration, light leakage from the edge portion of the light-emitting sheet portion can be suppressed, and electrical insulation between wiring of the light-emitting panel and the front panel and the back panel can be more reliably secured.

As described above, according to the embodiment, it is possible to provide a back panel for a lighting device that can flexibly cope with a change in a thickness of a light-emitting panel, and a lighting device including the back panel.

This application is based on Japanese Patent Application No. 2020-174609 filed with the Japan Patent Office on Oct. 16, 2020 and Japanese Patent Application No. 2021-152091 filed with the Japan Patent Office on Sep. 17, 2021, the contents of which are incorporated herein by reference.

Although the present invention has been fully described through the embodiments with reference to the accompanying drawings, it should be understood that various modifications and improvements can be readily made by those skilled in the art. Therefore, it should be understood that such modifications and improvements are included in the scope of the present invention unless they are at a level departing from the scope of the present invention described below.

The invention claimed is:

1. A back panel for a lighting device for holding a light-emitting panel for lighting with a front panel, the light-emitting panel having a length, a width, and a thickness that are orthogonal to each other, and being sandwiched by the back panel in a thickness direction of the light-emitting panel, the back panel comprising:

a panel main body disposed along a back surface on a side opposite to a light-emitting surface of the light-emitting panel at a time of holding the light-emitting panel, the time when the light-emitting panel is held by the back panel for a lighting device; and a front panel holding portion that holds the front panel at a position where the front panel sandwiches the light-emitting panel with the panel main body at the time of holding the light-emitting panel, wherein the front panel holding portion includes a first spacer portion and a second spacer portion that are to be placed between the front panel and the panel main body to form a gap that houses the light-emitting panel between the front panel and the panel main body, the first and second spacer portions are separably attached to the panel main body, the first spacer portion extends along a first end in a width direction of the light-emitting panel over the entire length of the light-emitting panel, and the second spacer portion extends along a second end in the width direction of the light-emitting panel over the entire length of the light-emitting panel.

2. The back panel for a lighting device according to claim 1, wherein the front panel holding portion further includes a panel fastening screw that fastens the front panel to the panel main body in a state where the first and second spacer portions are placed between the front panel and the panel main body at the time of holding the light-emitting panel.

3. A lighting device comprising:

the back panel for a lighting device according to claim 1, in which at least a part of the panel main body is curved;

the light-emitting panel is curved along one main surface of the panel main body; and the front panel is curved along the light-emitting panel.

4. The lighting device according to claim 3, wherein the front panel holding portion includes a spacer fastening screw for fastening the first and second spacer portions to the panel main body, and the front panel has a screw opening portion opened such that a head portion of the spacer fastening screw is disposed inside.

5. The lighting device according to claim 3, wherein the light-emitting panel has flexibility, the front panel is made of an elastic material, and the light-emitting panel and the front panel are coupled to each other and integrally curved along the one main surface.

6. The lighting device according to claim 3, wherein the light-emitting panel is curved along a convex surface of the panel main body.

7. The lighting device according to claim 3, wherein the light-emitting panel includes a light-emitting sheet portion and a cover portion that covers an edge portion of the light-emitting sheet portion and has a light shielding property and an electrical insulation property.

8. The lighting device according to claim 4, wherein the light-emitting panel has flexibility, the front panel is made of an elastic material, and the light-emitting panel and the front panel are coupled to each other and integrally curved along the one main surface.

9. The lighting device according to claim 4, wherein the light-emitting panel is curved along a convex surface of the panel main body.

10. The lighting device according to claim 4, wherein the light-emitting panel includes a light-emitting sheet portion and a cover portion that covers an edge portion of the light-emitting sheet portion and has a light shielding property and an electrical insulation property.

* * * * *